US008608184B2

(12) United States Patent
Janis et al.

(10) Patent No.: US 8,608,184 B2
(45) Date of Patent: Dec. 17, 2013

(54) MOBILITY ASSISTANCE DEVICE

(75) Inventors: Leonard R. Janis, Columbus, OH (US); Matthew Comer, Marion, OH (US)

(73) Assignee: Leonard R. Janis, Columbus, OH (US)

( * ) Notice: Subject to any disclaimer, the term of this patent is extended or adjusted under 35 U.S.C. 154(b) by 453 days.

(21) Appl. No.: 12/916,923

(22) Filed: Nov. 1, 2010

(65) Prior Publication Data

US 2011/0109058 A1 May 12, 2011

Related U.S. Application Data

(60) Provisional application No. 61/258,744, filed on Nov. 6, 2009.

(51) Int. Cl.
*A61H 3/00* (2006.01)

(52) U.S. Cl.
USPC ..... 280/87.03; 280/87.05; 280/87.021

(58) Field of Classification Search
USPC ..... 280/87.01–87.051; 482/66, 68, 69
See application file for complete search history.

(56) References Cited

U.S. PATENT DOCUMENTS 5,137,102 A 8/1992 Houston et al.
5,167,597 A 12/1992 David
5,526,893 A * 6/1996 Higer ..... 180/65.1
5,692,762 A 12/1997 Obitts
5,800,317 A 9/1998 Accetta
5,839,740 A 11/1998 Seeger
5,855,387 A 1/1999 Gill et al.
5,964,473 A 10/1999 Degonda et al.
6,129,415 A 10/2000 Galloway
6,440,046 B1 8/2002 Tholkes
6,474,666 B1 11/2002 Anderson et al.
6,494,469 B1 12/2002 Hara et al.
6,634,660 B2 10/2003 Miller
6,830,255 B2 * 12/2004 Cheng ..... 280/87.041
6,848,696 B2 2/2005 Miller
7,001,313 B1 2/2006 Crnkovich
7,287,767 B1 10/2007 Gomes et al.
7,311,319 B1 12/2007 Ortega
2004/0243038 A1 12/2004 Patterson
2006/0288525 A1 12/2006 Levin
2007/0182116 A1 8/2007 Davey et al.
2008/0284125 A1 11/2008 Ramm et al.
2009/0058036 A1 3/2009 Hoepner et al.
2009/0152829 A1 6/2009 Anderson

* cited by examiner

*Primary Examiner* — Katy M Ebner
(74) *Attorney, Agent, or Firm* — Tarolli, Sundheim, Covell & Tummino LLP

(57) ABSTRACT

A mobility assistance device for use as a walking aid includes a frame member extending from a front assembly to a rear assembly. The front and rear assemblies comprise a pair of wheels for rotational movement of the assistance device. The mobility device further comprises an energy absorption assembly located between the frame member and an axle housing of a rear assembly. The energy absorption assembly includes first and second ends, the first end is operably connected to a rearward position of the frame member and the second end is rotatably connected to the axle housing assembly supporting the pair of wheels of the rear assembly.

20 Claims, 27 Drawing Sheets

MOBILITY ASSISTANCE DEVICE

CROSS-REFERENCES TO RELATED APPLICATIONS

The present application claims priority to U.S. provisional patent application Ser. No. 61/258,744 entitled MOBILITY ASSISTANCE DEVICE filed on Nov. 6, 2009. The present application further incorporates by reference in its entirety for all purposes the above-identified provisional application Ser. No. 61/258,744.

TECHNICAL FIELD

The present disclosure relates to a mobility assistance device, and more specifically, a mobility assistance device for use as a walking aid by the elderly, disabled, or persons recovering from an injury and/or medical treatment.

BACKGROUND

Various devices acting as a walking aid that are well known include canes, walkers, wheelchairs, and crutches. Generally, such well-known walking aids are used to minimize the weight of the user experienced on a leg joint, bones, tendons, muscles, or any combination thereof. However, most of the walking aids identified above have restrictions, limiting their use. For example, most of the above-mentioned aids are generally difficult to use when traversing uneven, loose, or slippery terrain.

The creation of knee caddies or knee scooters have provided a significant improvement to the mobility of its users when compared to the traditional walking aids discussed above. The knee caddies or knee scooters facilitate both support and balance while allowing the mobility of the user to be more efficient. The knee caddy's wheels and user's ability to maintain one leg on the ground during use adds to the stability and mobility of a knee caddy walking aid, mitigating the concerns identified above relating to uneven terrain or loose soil. In addition, the user's ability to steer the knee caddy or knee scooter provides both control and efficiency by shortening the path and time of use required to obtain the user's final destination.

SUMMARY

One example embodiment of the present disclosure includes a mobility assistance device for use as a walking aid comprising an arcuate frame member extending from a front assembly to a rear assembly. The front and rear assemblies include a pair of wheels for rotational movement of the assistance device. A support assembly extends from the arcuate frame member and is positioned between the front and rear assemblies for supporting a leg of an operator during use. The mobility assistance device further comprises a steering assembly extending from the front assembly providing directional control of the mobility assistance device during use. An energy absorption assembly is located between the arcuate frame member and a rear axle housing of the rear assembly. The energy absorption assembly includes first and second ends. The first end is rotatably connected to a rearward position of the arcuate frame member and the second end is rotatably connected to the rear axle housing assembly that is rotatably connected to the pair of wheels of the rear assembly.

While another example embodiment of the present disclosure comprises a mobility assistance device having a frame member with a set of wheels rotatably connected thereto for rotational movement of the assistance device. The device further comprises a support assembly rotatably connected to the frame member about a first pivot point at a first end of the support assembly, the support assembly is operably connected at a second end to an axle housing operably connected to the set of wheels. The device also comprises a spring assembly operably connected at a proximal end to the frame member and rotatably connected at distal end to form a second pivot point with the axle housing, the mobility assistance device pivots about the first and second pivot points upon experiencing a change in the load on the device.

In another example embodiment of the present disclosure, the energy absorption assembly of the mobility assistance device further comprises a dampening unit. In one exemplary embodiment, the dampening unit comprises a solid or hysteretic dampening system. In yet another embodiment, the solid or hysteretic dampening system is constructed from a deflector plate positioned between the arcuate frame member and rear axle housing.

In yet another example embodiment the present disclosure comprises a mobility assistance device for use as a walking aid includes a frame member extending from a front assembly to a rear assembly. The front and rear assemblies comprise a pair of wheels for rotational movement of the assistance device. The mobility device further comprises an energy absorption assembly located between the frame member and an axle housing of a rear assembly. The energy absorption assembly includes first and second ends, the first end is operably connected to a rearward position of the frame member and the second end is rotatably connected to the axle housing assembly supporting the pair of wheels of the rear assembly.

Another example embodiment of the present disclosure includes a mobility assistance device for use as a walking aid. The mobility assistance device comprises a frame member having an arcuate portion. The frame member extends from a front assembly to a rear assembly where the front and rear assemblies comprise a pair of wheels for rotational movement of the assistance device. The device also includes a support assembly extending from the frame member and is positioned between the front and rear assemblies for supporting a limb of an operator during use. The support assembly comprises a sling arrangement having an arcuate web formed from fabric. The device also includes a steering assembly extending from the front assembly providing directional control of the mobility assistance device during use. The device also comprises an energy absorption assembly located between the arcuate portion of the frame member and a rear axle housing of the rear assembly. The energy absorption assembly includes first and second ends, the first end being operably connected to the arcuate portion of the frame member and the second end being rotatably connected to the rear axle housing assembly that is rotatably connected to the pair of wheels of the rear assembly.

While another example embodiment of the present disclosure includes a mobility assistance device for use as a walking aid comprising a frame member having an arcuate portion. The frame member extends from a front assembly to a rear assembly wherein the front and rear assemblies comprise a pair of wheels for rotational movement of the assistance device. The device further comprises a support assembly extending from the frame member and positioned between the front and rear assemblies for supporting a limb of an operator during use. The support assembly comprises a sling arrangement having an arcuate web formed from fabric. The device also includes a steering assembly extending from the front assembly providing directional control of the mobility assistance device during use. The steering assembly comprising a pivot assembly for rotatably positioning a steering column and attached handle bar between a collapsed position and an upright position. The device also has an energy absorption assembly located between the arcuate portion of the frame member and a rear axle housing of the rear assembly. The energy absorption assembly comprises first and second ends, the first end being operably connected to the arcuate portion of the frame member and the second end being rotatably connected to the rear axle housing assembly that is rotatably connected to the pair of wheels of the rear assembly. The device also includes a rear fork assembly having proximal and distal ends. The proximal end is rotatably connected to the frame member and the distal end being fixedly connected to the axle housing such that concurrent rotation occurs along the second end of the energy absorption assembly and the proximal end of the rear fork assembly during loading to enhance the energy absorption of the energy absorption assembly.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Figure 1:
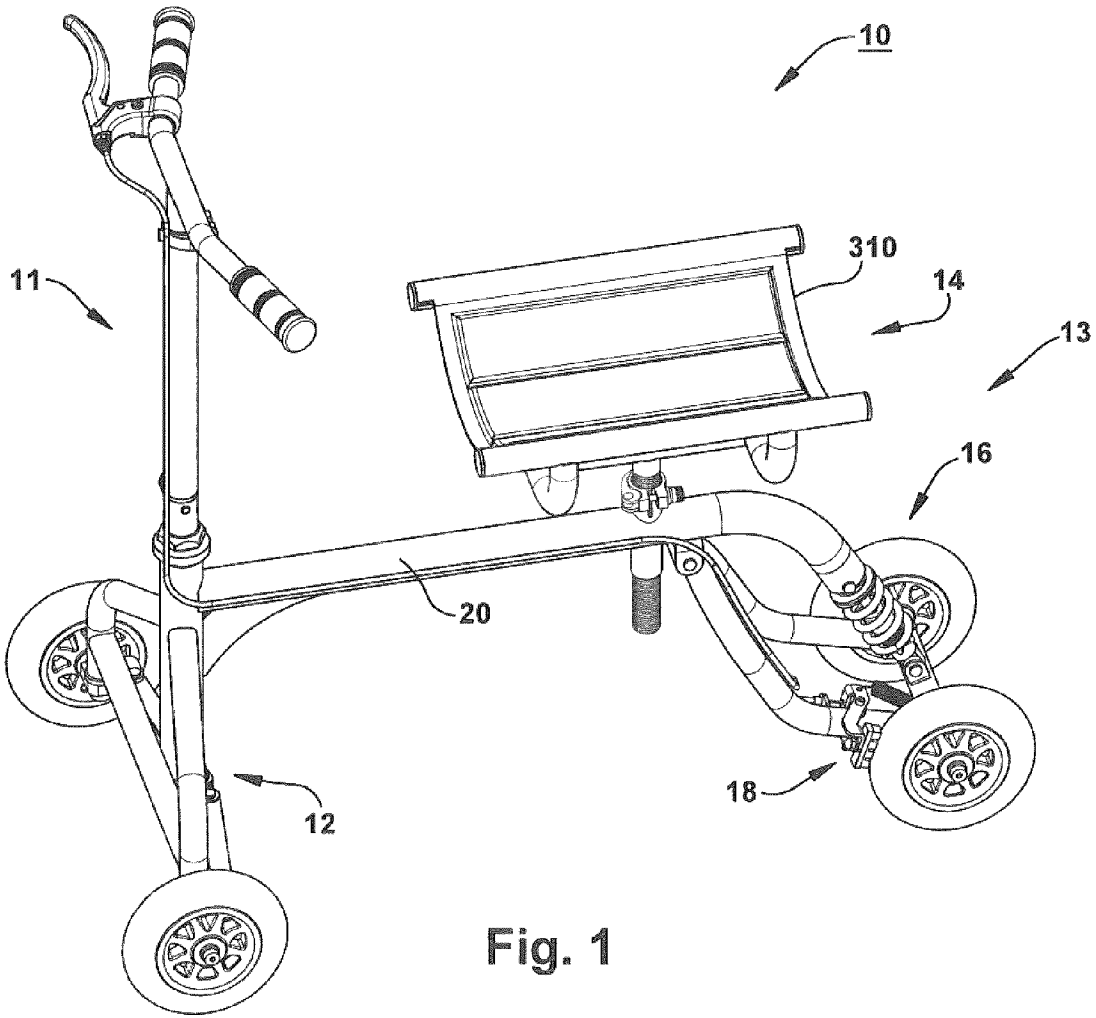
FIG. 1 is a perspective view of a mobility assistance device constructed in accordance with one embodiment of the present disclosure.

The present disclosure relates to a mobility assistance device, and more specifically, a mobility assistance device for use as a walking aid by the elderly, disabled, or persons recovering from an injury and/or medical treatment, such as surgery. Illustrated in FIGS. 1-6 is a perspective view of a mobility assistance device 10 constructed in accordance with one embodiment of the present disclosure. The mobility assistance device 10 (also referred herein as a knee caddy) is constructed from several different assemblies and an arrangement that includes a steering assembly 12, support assembly 14, energy absorbing assembly 16, and braking arrangement 18. The aforementioned arrangement and assemblies are connected together to form the knee caddy 10 through a frame member 20, as best seen in FIG. 2 that provides structural support to the user from a front end 11 to a rear end 13 of the caddy.

The frame member 20 in one example embodiment, is formed from a hollow steel or chromoly steel (containing both chromium and molybdenum) tubular member generally of a circular cross-sectional area, but could include any number of geometrical cross-sectional areas or materials of equal or greater strength without departing from the spirit and scope of the claimed disclosure. In the illustrated example embodiments, the frame member 20 is made from 1 and ½ inch diameter circular steel tubing having a 16 Ga. wall thickness. While it should be appreciated by those skilled in the art that a heavier wall thickness and larger, thus stronger cross-sectional geometry could be used for heavy duty knee caddies, which are intended to be within the scope of the present disclosure.

Figure 16:
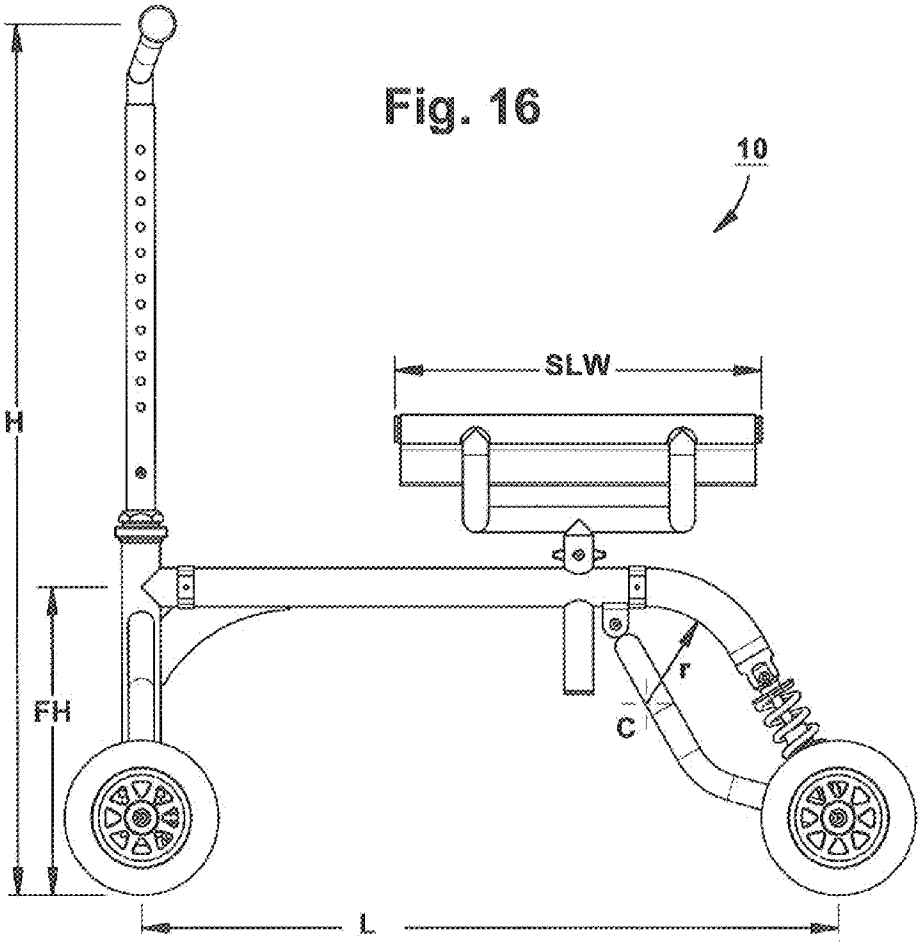
FIG. 16 is an elevation side view of the mobility assistance device shown in FIG. 12.

The frame member 20 includes a horizontal portion 20A, extending from a front support assembly 22 to a rear support assembly 24, as best seen in FIG. 2. The frame member 20 further comprises an arcuate portion 20B, curving from the termination of the horizontal portion 20A at rear support assembly 24 to the energy absorption assembly 16. The arcuate portion 20B provides an aerodynamic or streamline appearance to the mobility assistance device 10. In the illustrated example embodiment, the arcuate portion 20B has a radius "r" of approximately five (5") inches from its center "C", as best seen in FIG. 16.

Figure 20:
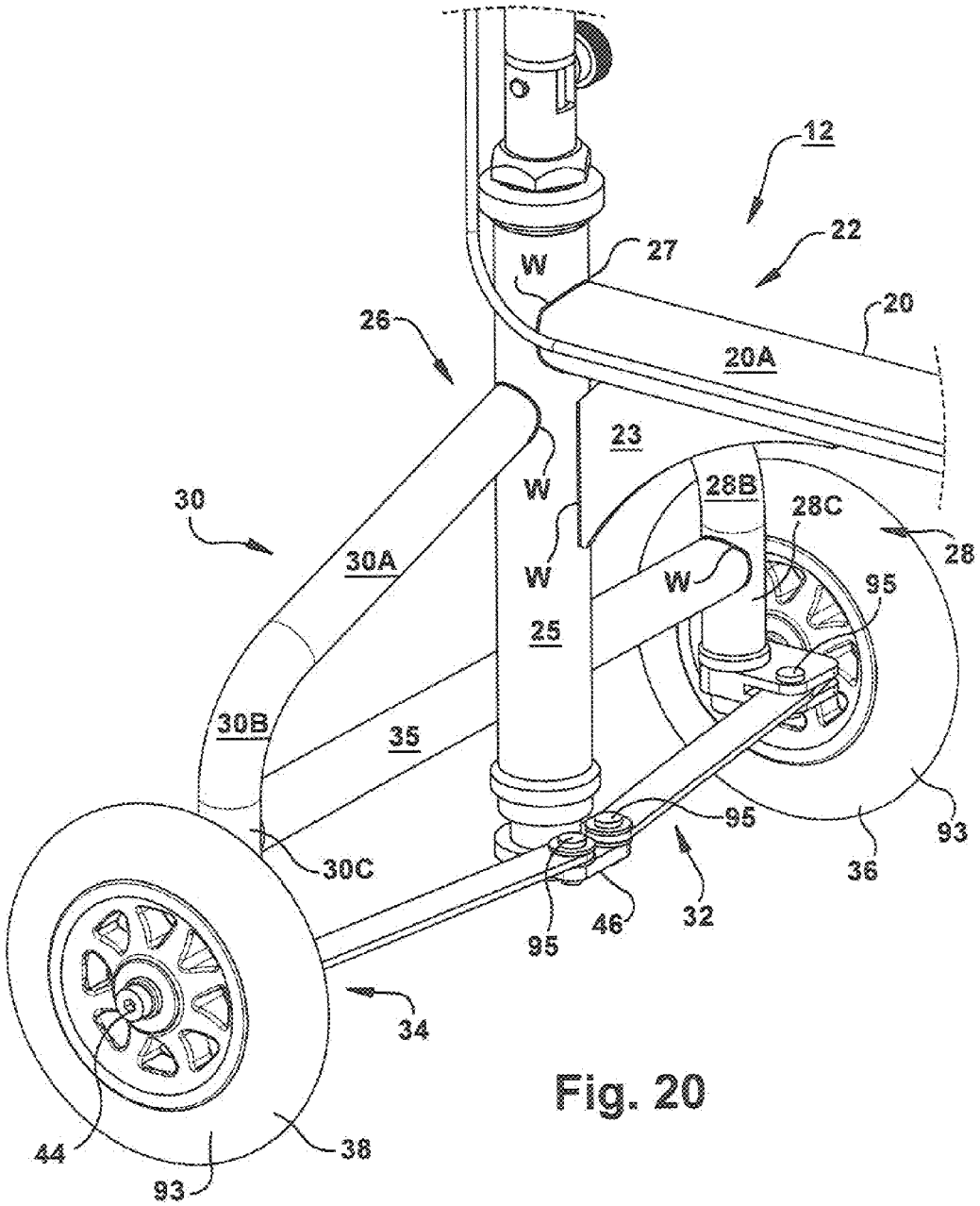
FIG. 20 is a partial perspective view of a steering assembly for a mobility assistance device constructed in accordance with one embodiment of the present disclosure.

The front support assembly 22 comprises a post support 25 having an upper end 27 connected to the horizontal portion 20A of frame member 20. The frame member 20 and its attachment to the support assembly 22 is achieved by welding respective components together as appreciated by one skilled in the art. Welds ("W") are shown connecting the various components together, for example, in FIG. 20. The device 10 in the illustrated embodiment, achieves further stability through the welded connection of a welded gusset 23 between the post support 25 and frame member 20. The gusset 23 in the illustrated embodiment is made from 11 Ga steel.

The post support 25 is vertically and symmetrically located about a front fork 26 formed from first and second extensions 28, 30, respectively, projecting downwardly about opposite sides of the frame member 20 and post 25 to first and second wheel axle assemblies 32, 34, respectively. The first and second wheel axle assemblies 32, 34 are connected to first and second wheels 36, 38, respectively. The first and second extensions 28 and 30 comprise diverging sections 28A, 30A ascending downward at approximately 135 degrees from post support 25 (as indicated by angle $\alpha$ in FIG. 3) to arcuate sections 28B, 30B that connect to upright sections 28C, 30C. While the first and second extensions 28 and 30 help support the front end 11 of frame member 20 and an unlimited number of structural configurations could be used, the shape and design forming the first 28 and second 30 extensions of the illustrated embodiment of FIG. 2 was chosen to provide an ornamental look comprising an aerodynamic or streamline appearance to the mobility assistance device 10.

The front support assembly 22 further comprises a lateral brace 35 that connects the first and second extensions 28, 30 over a horizontal plane. In the illustrated example embodiment of FIG. 1, the post support 25 is made from the same material and size tubing as the frame member 20, while the remaining components of the front fork 26 are made from the same material having a circular cross-sectional area, but comprise a steel tubing approximately one-inch (1") in diameter circular steel tubing having a 16 Ga. wall thickness.

Steering Assembly 12 and Operation

Figure 21:
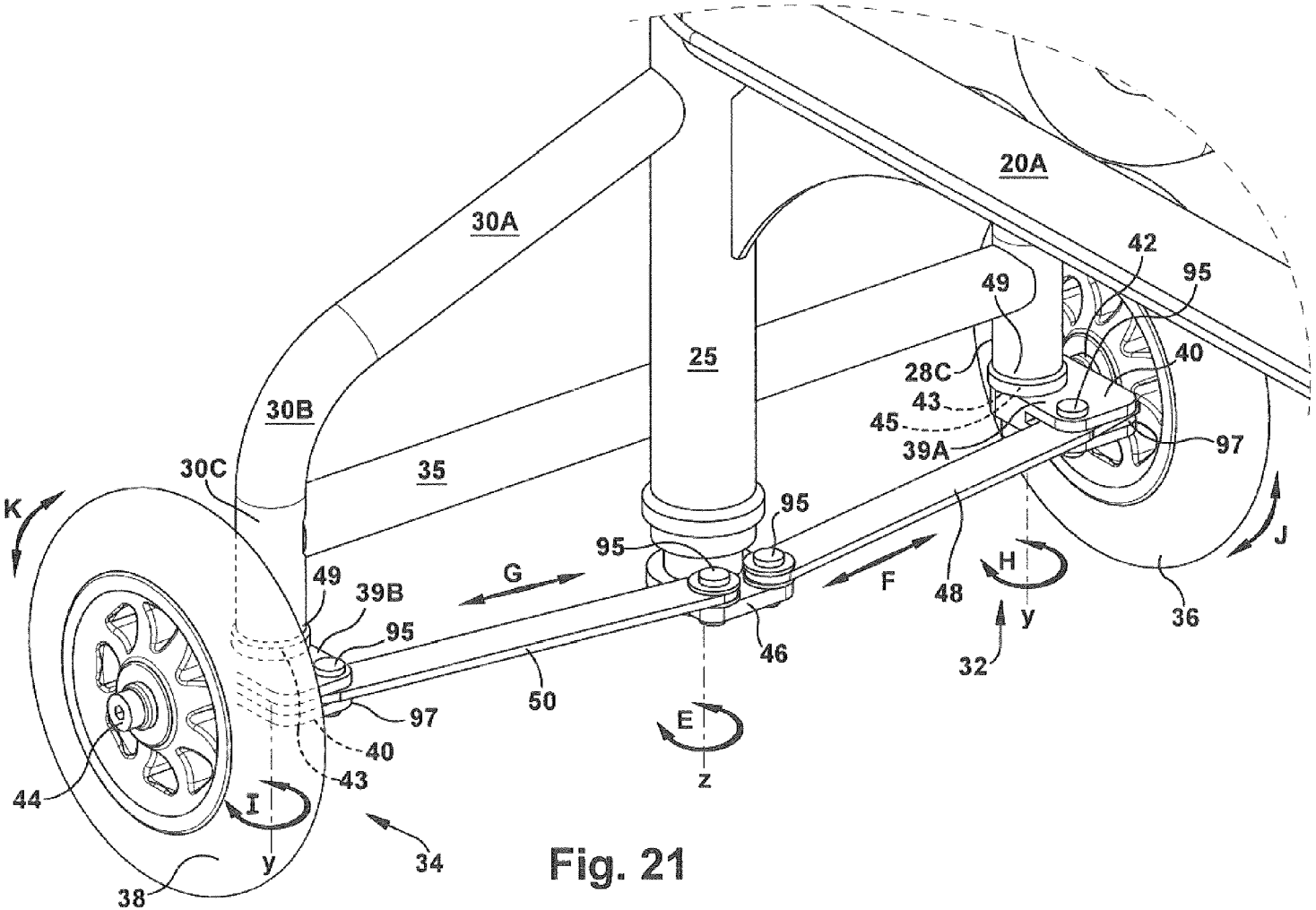
FIG. 21 is a magnified view of the steering assembly of FIG. 20.
Figure 30:
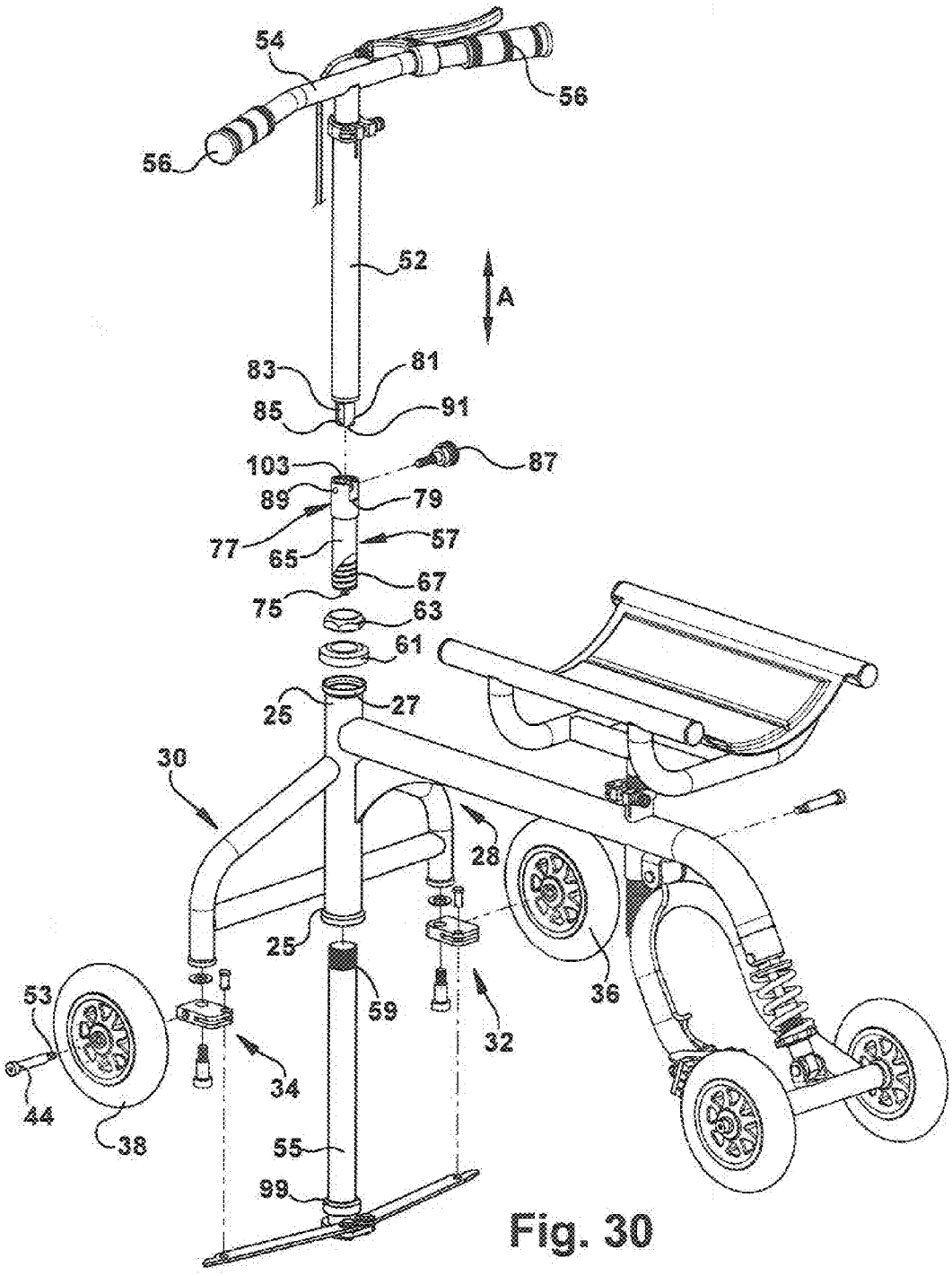
FIG. 30 is an exploded view of a mobility assistance device constructed in accordance with one embodiment of the present disclosure.
Figure 31:
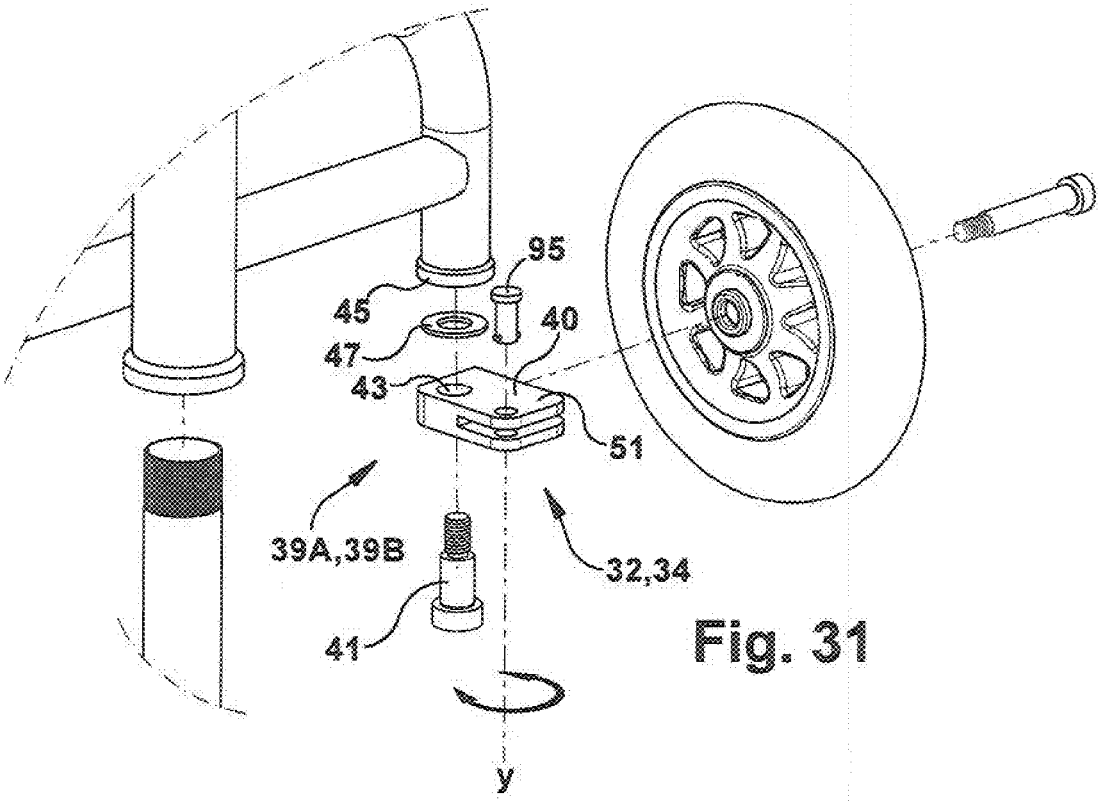
FIG. 31 is a magnified view of a portion of the mobility assistance device illustrated in FIG. 30.

The first and second axle wheel assemblies 32, 34, respectively are rotatably secured to first and second tie rod end assemblies 39A and 39B as illustrated in FIGS. 21, 30, and 31. The tie rod end assemblies 39A and 39B include a flange body 40 rotationally connected to the vertical extensions 28, 30 by a fastener 41 passing through an aperture 43 located within the flange into a corresponding tapped or threaded connection 45 located within the vertical extensions. Facilitating the rotation of the tie rod end assemblies 39A and 39B about respective vertical axes "y" as shown in FIGS. 21 and 31, is the positioning of annular thrust bearings 47 that pass over the fastener 41 and rest on a top surface 51 of the flange body 40. The annular thrust bearings 47 for each tie rod assemblies 39A and 39B are rotatably positioned within respective hubs 49, such that the top surfaces 51 of the flanges 40 do not contact the hub 49 during rotation. Instead, the rotational load experienced on the tie rod end assemblies 39A and 39B is carried by the annular thrust bearings 47. In the illustrated example embodiment of FIGS. 21, 30, and 31, the fasteners 41 are shoulder bolts.

The tie rod end assemblies 39A and 39B are coupled to the wheel axle assemblies 32 and 34, which are journaled to support first and second wheel axles, 42, 44 for first and second wheels 36, 38, respectively. The wheels 36, 38 have radial bearings raced to rotate about axles 42 and 44. The axles 42, 44 further comprise a threaded end 53 that is received and fixedly attached into a corresponding tapped opening in the side of the flange 40.

The steering assembly 12 comprises in addition to first and second wheel axle assemblies 32, 34, and tie rod assemblies 39A and 39B, a control arm 46, first and second control links 48, 50, an upper steering column 52, steering bar 54, and lower steering column 55, as illustrated in FIGS. 20-21 and 30-31. The steering bar 54 includes handle grips 56 about opposite ends and is symmetrically fixed about its center to upper steering column 52. The upper steering column 52 extends from the steering bar 54 into a locking support arrangement 57. The locking support arrangement 57 partially extends into post support 25 and into the inner diameter of the lower steering rod 55, as illustrated in FIG. 30. The lower steering rod 55 is rotatably housed in, and extends through, post support 25. In one example embodiment, the handle or steering bar 54 is formed for increased comfort and stability.

The lower steering rod 55 includes a threaded end 59 that extends outwardly from the upper end 27 of the support post 25, where it is rotatably secured about the support post 25 by an annular bearing set 61 and nut 63, as further illustrated in the example embodiment of FIG. 30. The locking support arrangement 57 comprises a securing portion 65 and collapsible region 77. The securing portion 65 is received inside the lower steering column 55, and includes a moveable wedge 67 that translates up and down in the direction of Arrows A (FIG. 30) when a threaded adjustment 75 (such as a screw) is rotated. When the threaded adjustment 75 is rotated such that the wedge 67 translates up the securing portion 65, the diameter of the securing portion 65 increases to create a fixed connection with the securing portion within the lower steering column 55. To decrease or release the securing portion 65 from the lower steering column 55, the threaded adjustment 75 is rotated in an opposite direction, thus lowering the moveable wedge 67 and thereby reducing the diameter of the securing portion.

Figure 11:
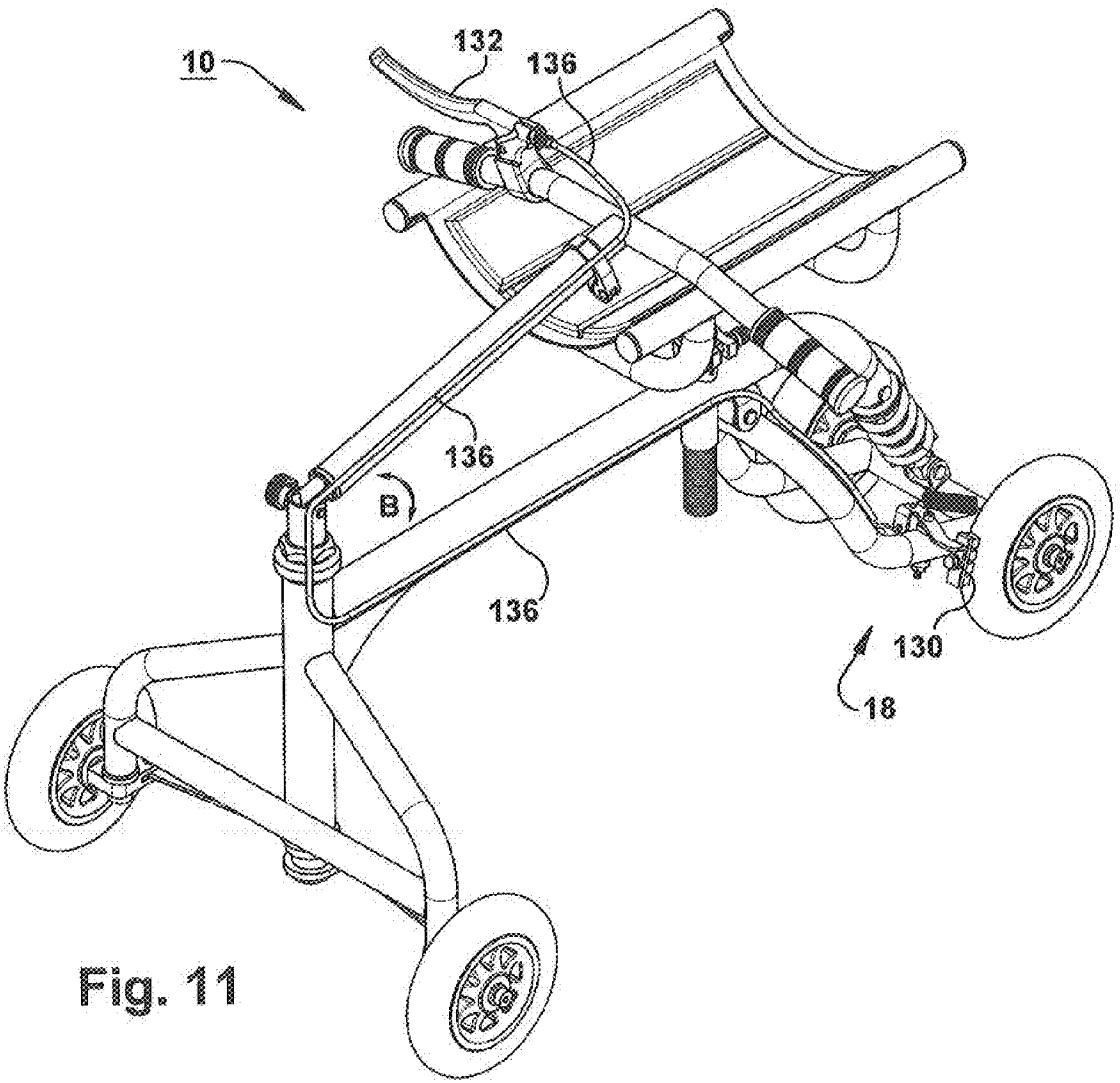
FIG. 11 is a perspective view of a mobility assistance device having a first storage configuration constructed in accordance with one embodiment of the present disclosure.

Referring to FIG. 11, a side elevation view of the mobility assistance device 10 is shown in a collapsed position for storage or transport in accordance with one example embodiment of the present disclosure. The mobility assistance device 10 includes a pivot assembly 77 that allows for a collapsible partial separation of the upper steering column 52. The pivot assembly 77 of the locking support arrangement 57 comprises a slotted opening 79 for providing select angular rotation of the upper steering column 52 and steering bar 54. To achieve the select angular rotation from a fixed or operable position shown in FIG. 1 to a rotated or stored position shown in FIG. 11 in the direction of Arrows B, a key 81 is provided at a distal end 83 of the upper steering column 52.

The key 81 is rotatably connected in the slotted opening 79 such that an aperture 85 allows for the passage of a fastener 87 through openings 89 in the collapsible region 77. The key 81 is loosened to allow for the rotational movement of the upper steering column 52 facilitated by a rounded surface 91 located at the bottom of the key and the slotted opening 79 being along a single direction and pivoting about the fastener 87 of the locking support arrangement 57.

Figure 2:
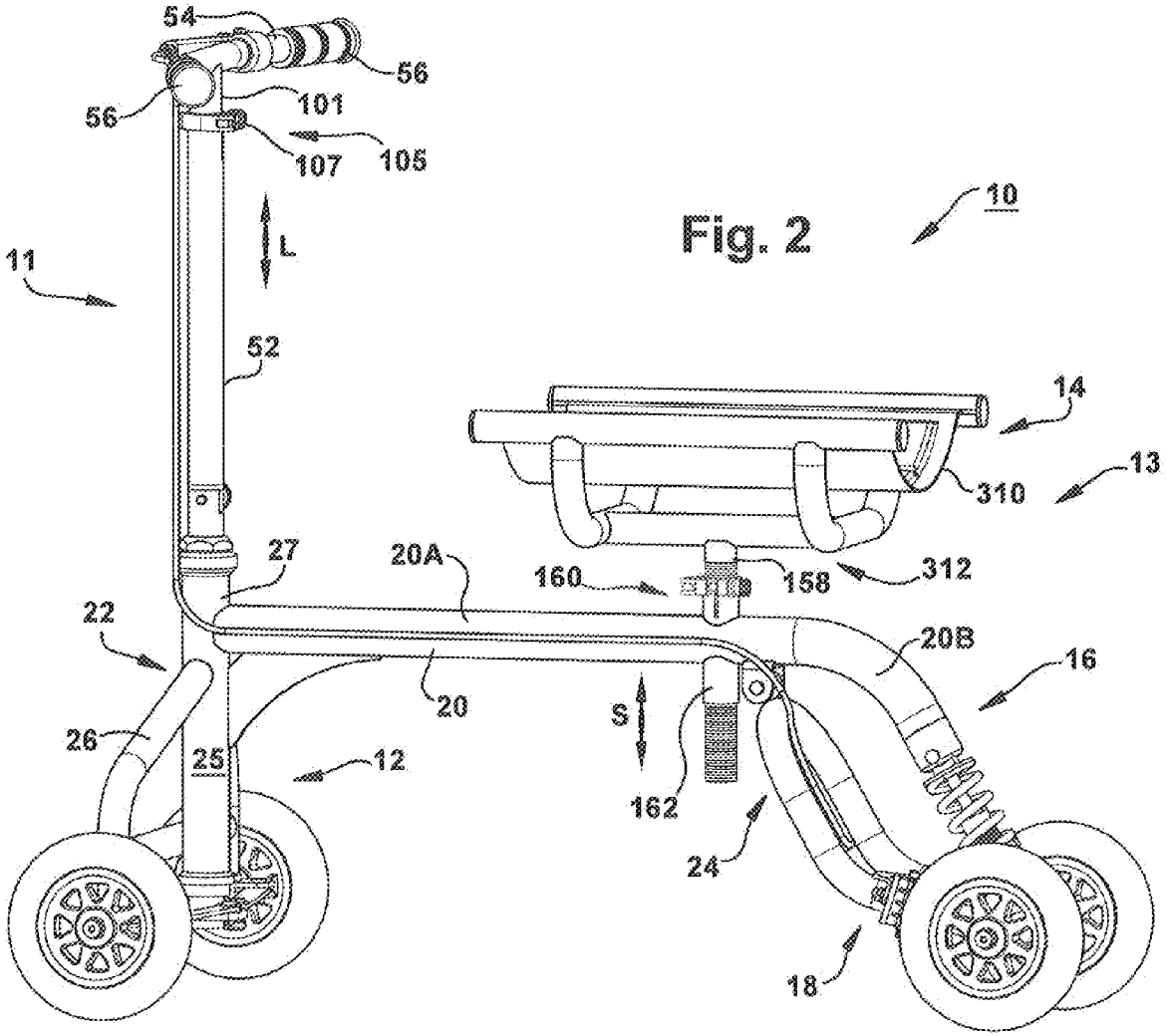
FIG. 2 is an elevation side view of the mobility assistance device shown in FIG. 1.
Figure 3:
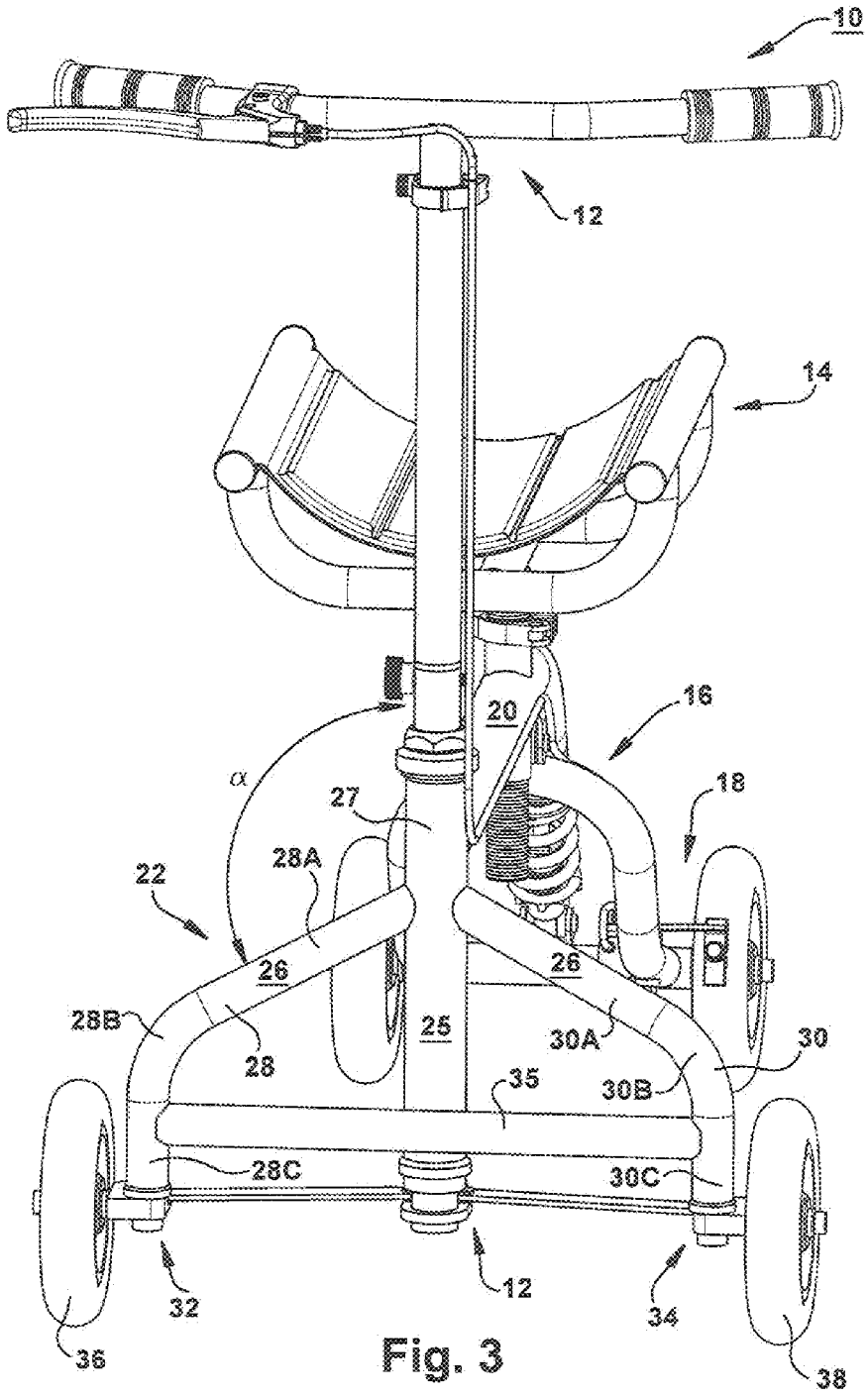
FIG. 3 is a front elevation view of the mobility assistance device shown in FIG. 1.
Figure 4:
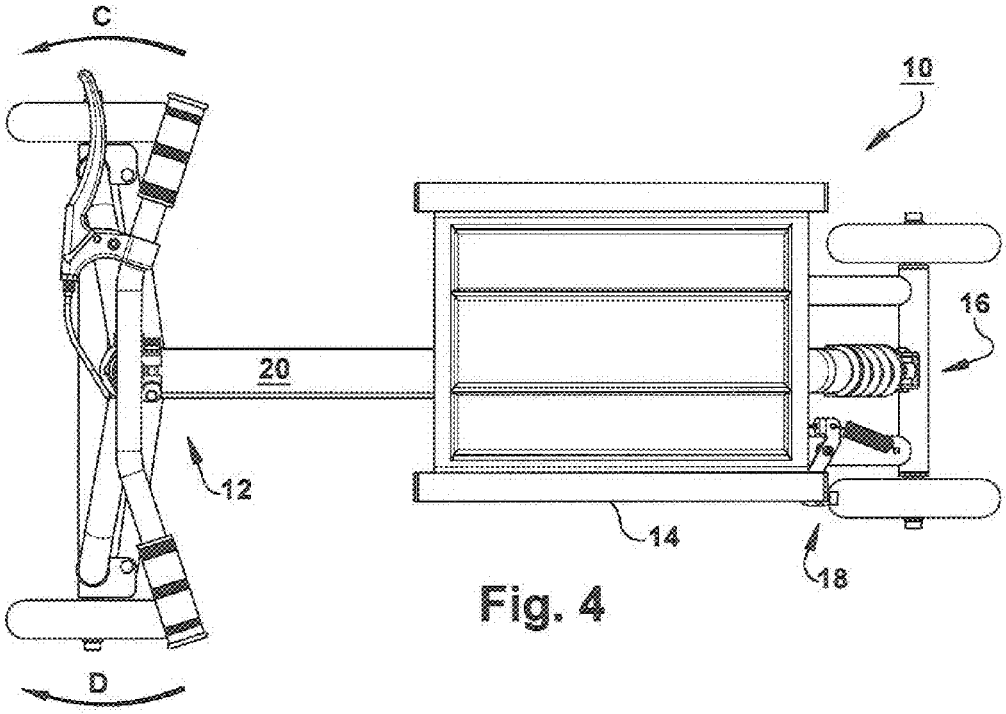
FIG. 4 is a plan view of the mobility assistance device shown in FIG. 1.
Figure 5:
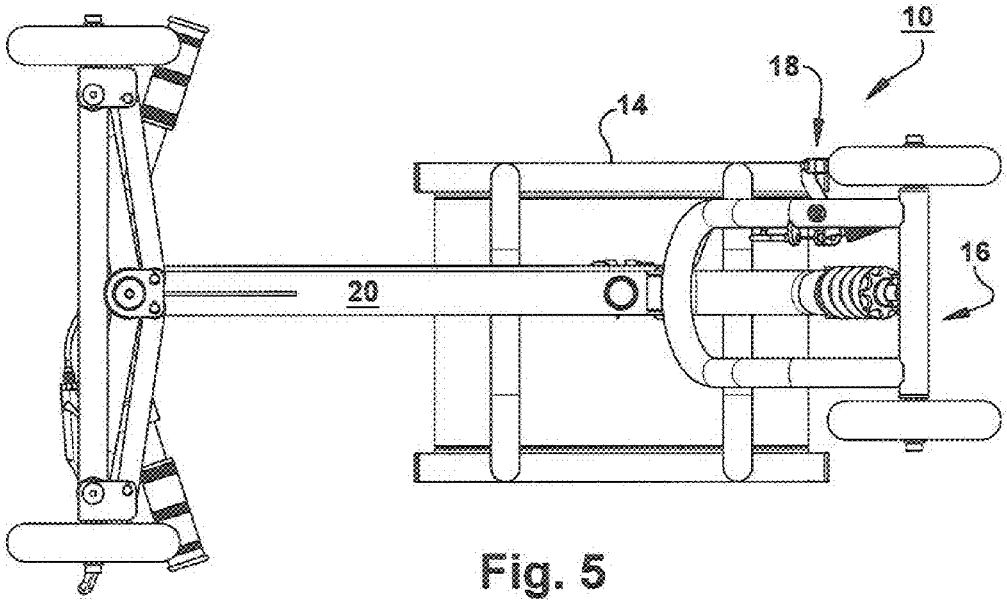
FIG. 5 is a bottom view of the mobility assistance device shown in FIG. 1.
Figure 7:
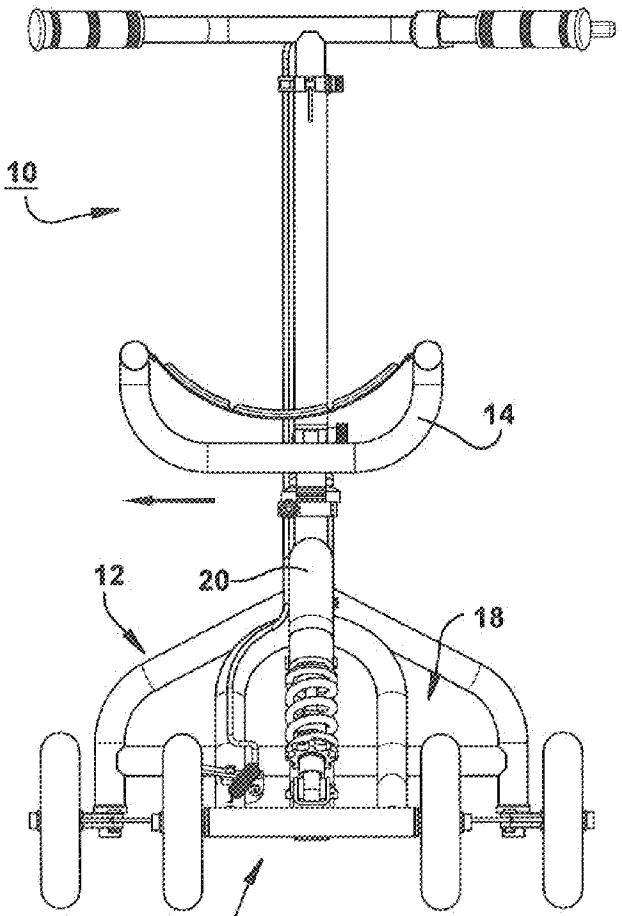
FIG. 7 is a rear elevation view of the mobility assistance device shown in FIG. 1 but with a support assembly positioned on a second side of the device.
Figure 6:
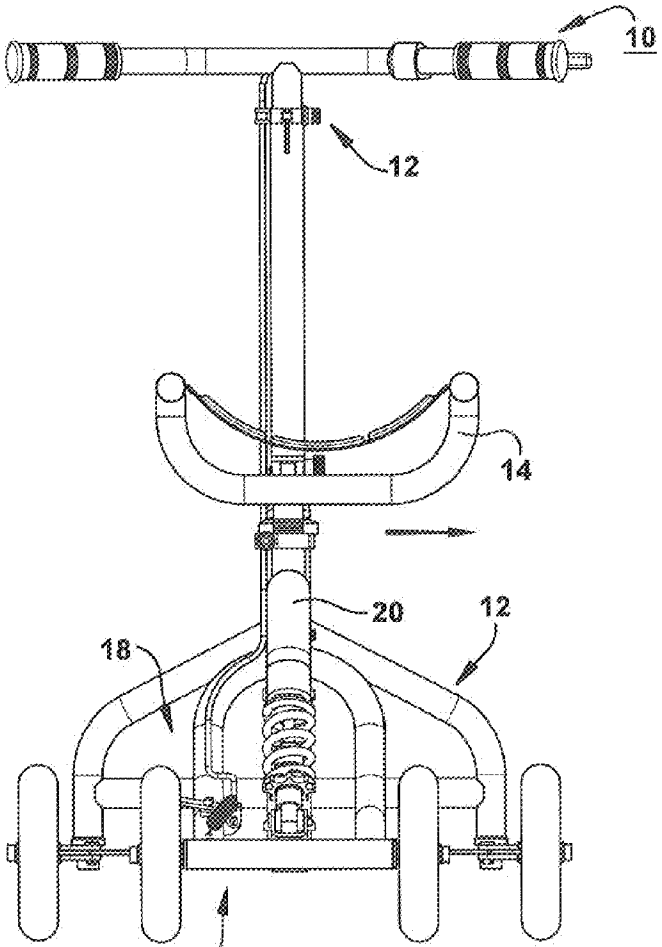
FIG. 6 is a rear elevation view of the mobility assistance device shown in FIG. 1 with a support assembly positioned on a first side of the device.
Figure 8:
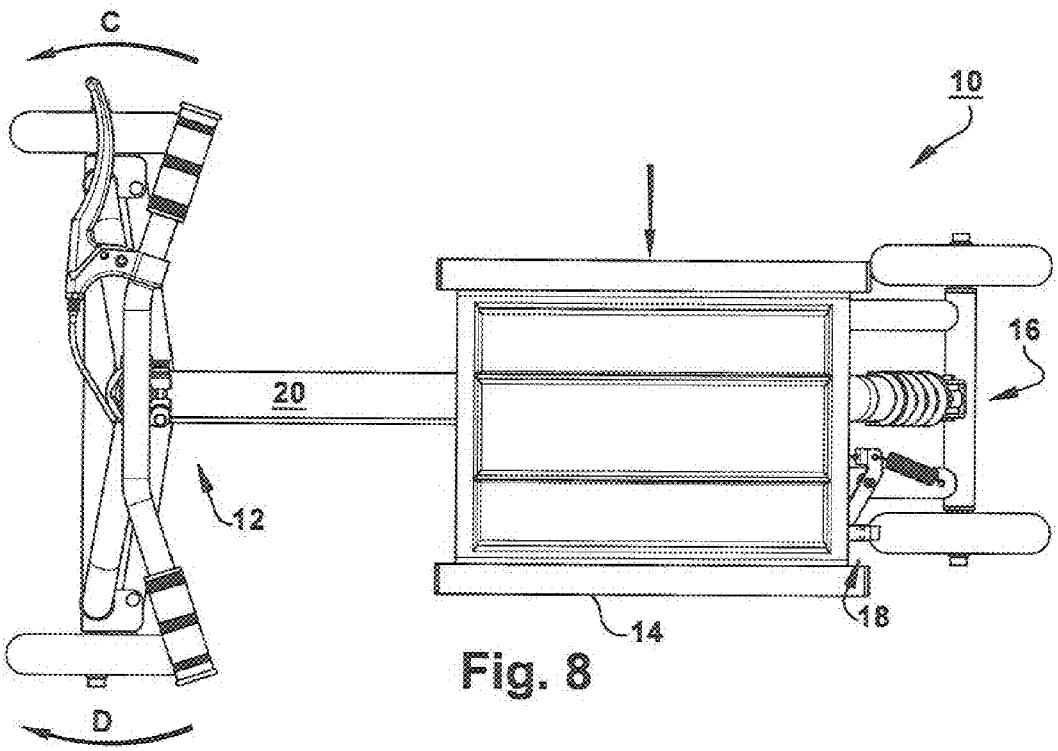
FIG. 8 is a plan view of the mobility assistance device shown in FIG. 1 but with a support assembly positioned on a second side of the device.
Figure 9:
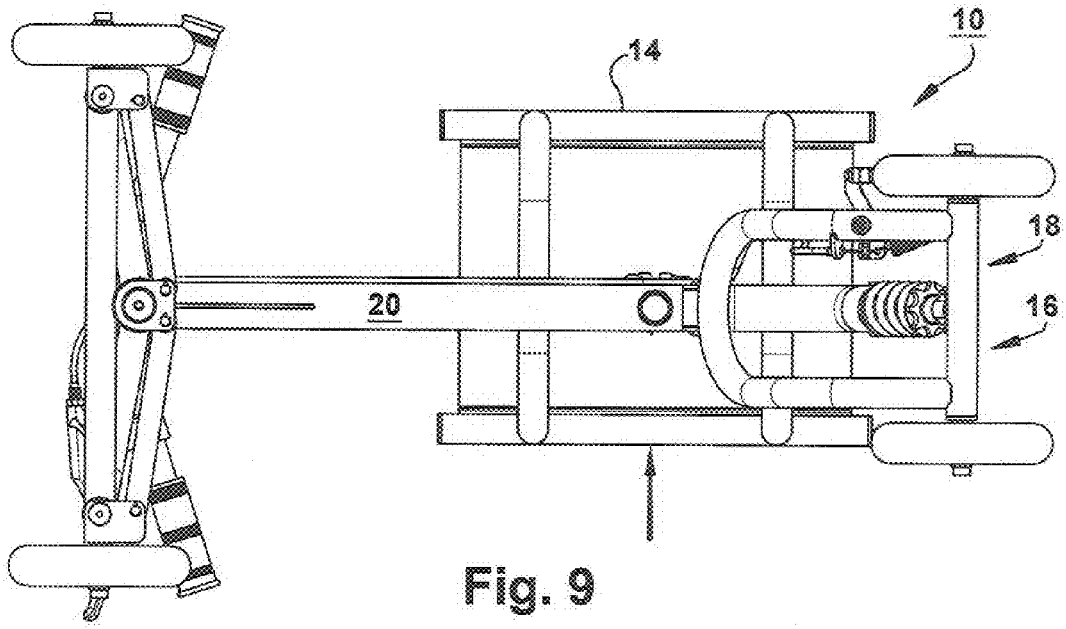
FIG. 9 is a bottom view of the mobility assistance device shown in FIG. 1 but with a support assembly positioned on a second side of the device.
Figure 10:
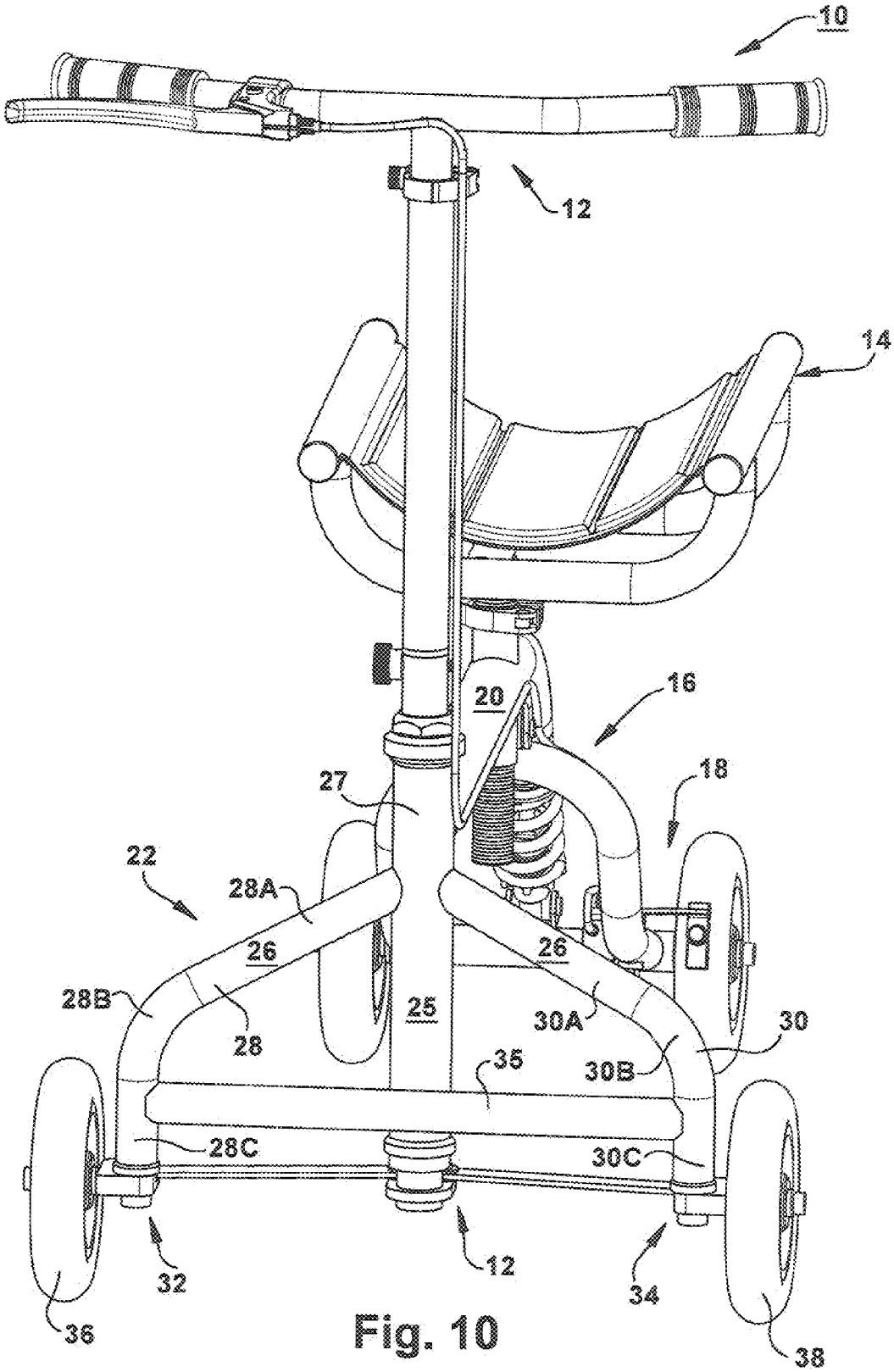
FIG. 10 is a front elevation view of the mobility assistance device shown in FIG. 1 but with a support assembly positioned on a second side of the device.

When the mobility assistance device 10 is removed from storage or from a vehicle during transport, the collapsible position is reverted to a usable or operable position shown in, for example, FIG. 1 or 2 by rotating the upper steering column 52 away from the support assembly 14 into an upright position, pivoting about the fastener 87. In the upright position, the upper steering column 52, and in particular, the key 81 engages a stop 103 located in the back of the pivot assembly 77. The upper steering column 52 is then locked or secured to into place through the tightening of fastener 87 such that the opening forming the slot 79 is reduced.

Figure 18:
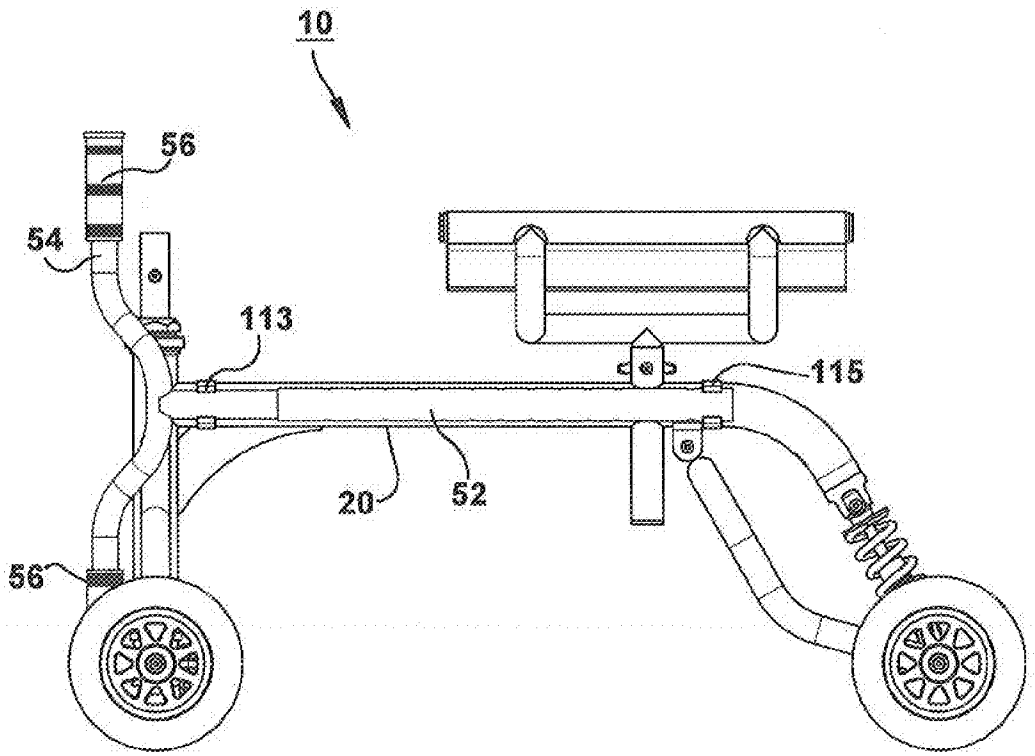
FIG. 18 is an elevation side view of the mobility assistance device shown in FIG. 12 in a storage position.
Figure 17:
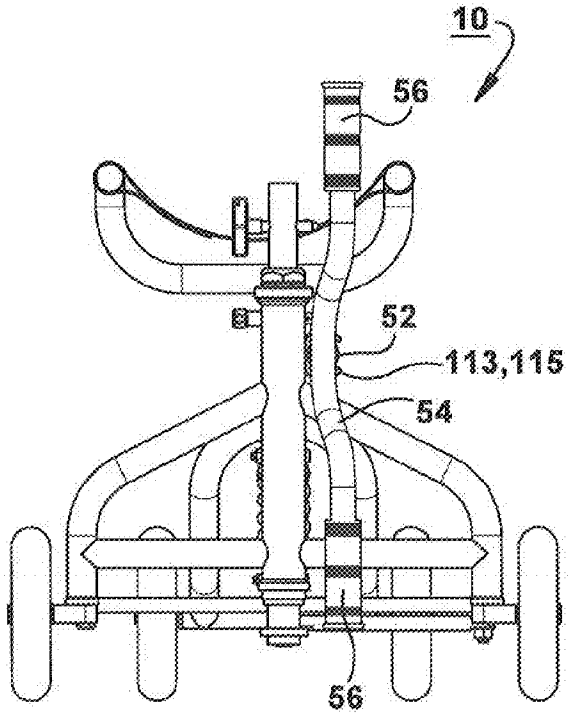
FIG. 17 is a front elevation view of the mobility assistance device shown in FIG. 12 in a storage position.

In an alternative example embodiment, the mobility assistance device 10 is stored or placed into a collapsible position by the removal of the upper steering column 52 and handle bar 54 from the frame member 20 and steering assembly as illustrated in FIGS. 17 and 18. In the illustrated example embodiment of FIGS. 17 and 18 and in the upright (operable) position of FIGS. 12 and 13, the upper steering column 52 includes a plurality of adjustment openings 109 for adjusting the height of the handle bar 54 relative to the frame member 20, as indicated by Arrows M. During height adjustment, the upper steering column 52 is translated to a desired height, and when the desired height is obtained, a pin 111 is passed through adjustment openings 109, thereby selectively locating the desired height.

Figure 13:
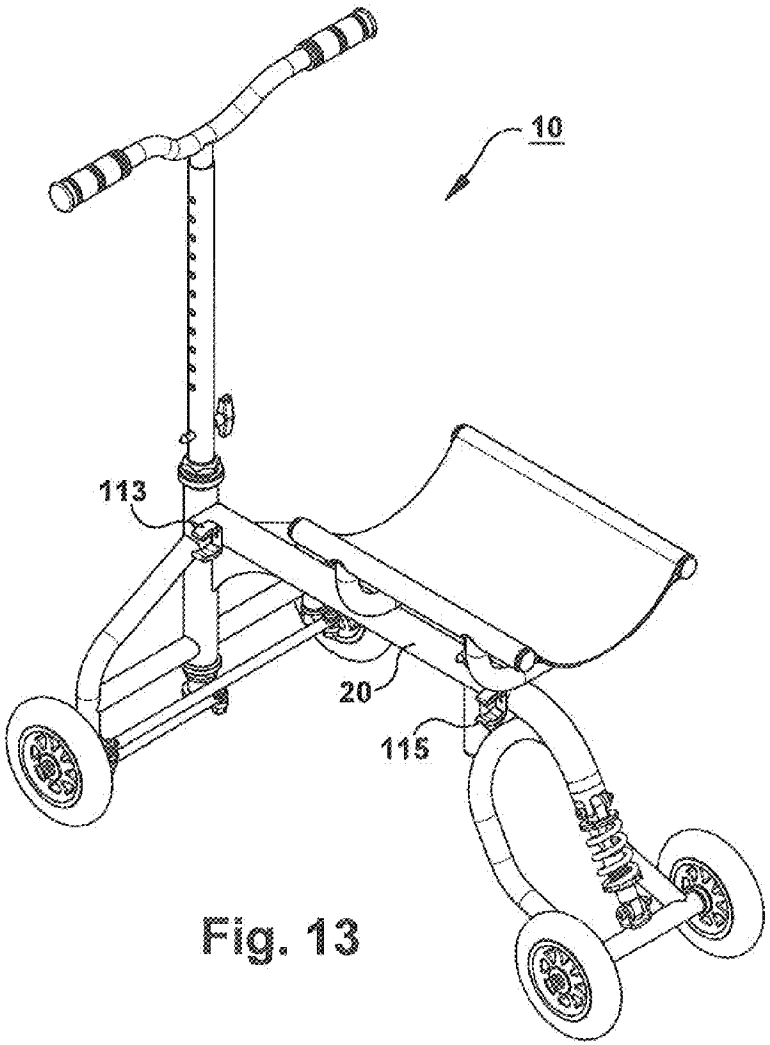
FIG. 13 is a rear perspective view of the mobility assistance device shown in FIG. 12.
Figure 12:
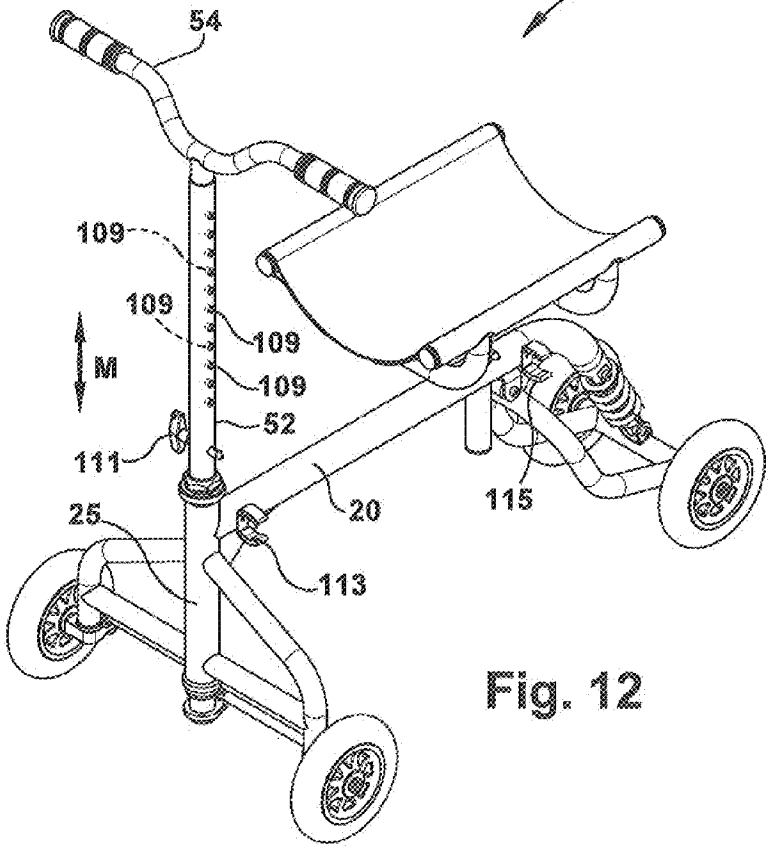
FIG. 12 is a front perspective view of a mobility assistance device having a second storage configuration constructed in accordance with one embodiment of the present disclosure.

To achieve a collapsed or storage position for transport, the device 10 in the example embodiment of FIGS. 12 and 13 requires the removal of the pin 111 from holes 109, allowing the upper steering column 52 and handle bar 54 to be removed from the support post 25. This significantly reduces the overall height of the device 10, as illustrated in FIGS. 17 and 18. To further facilitate the storage of the device 10, the frame member 20 also comprises in the example embodiment, first and second clasps 113 and 115, extending therefrom and fixedly attached thereto. The clasps 113 and 115 are formed from plastic and c-shaped for receiving the tubular shape of upper column 52 to a snap-like connection for convenient removal and storage.

Referring again to FIG. 20, first and second control links 48, 50, respectively, are rotatably connected to the tie rod assemblies 39A and 39B and to the control arm 46 through fasteners 95 such as bolts, screws, rivets, cotter pins, and the like. The first and second control links 48 and 50 are secured by fasteners 95 within a groove 97 located in each of the tie rod end assemblies 39A and 39B. All components from the steering assembly 12, except for the handle grips 56 and tires 93 (made from rubber or plastic) are made from metal such as steel. It is intended to be within the scope of the present disclosure, however, for other materials in addition to metal or steel to be used if of equal or greater strength, which can be achieved by changing the geometrical cross-section or wall thickness of the material. In one example embodiment, the tires 93 on all four wheels are six (6") inches in diameter and are pneumatically filled with fluid, such as air. One example of a suitable wheel/tire assembly is a six (6") inch black No-Matic Wheel with ball bearings, identified as part number SNF61-06-BLK-20 sold by Service Caster Corporation located at Riverfront Business Center, 9 First Avenue, West Reading, Pa. 19611.

During operation, a user of the mobility assistance device 10 navigates directional control by grasping the handle grips 56 and rotating the steering bar 54 to a desired direction of advancement that corresponds to an angular rotation (either counter-clockwise Arrow C or clockwise Arrow D in FIG. 4) of the upper steering column 52 relative to the fixed post support 25 that is secured to the frame member 20.

The angular rotation (shown in FIG. 4) of the upper steering column 52 results in a corresponding angular rotation of the locking arrangement 57 (when secured to the lower steering column 55 in the manner described above), lower steering column 55, and control arm 46 about axis "Z" in the directions of Arrows E shown in FIG. 21. Such angular rotation further results in pivotal movement (see Arrows F and G in FIG. 21) of the first and second control links 48, 50 about fasteners 95 that generates the rotational movement of the tie rod end assemblies 39A and 39B about axis "Y" (shown by Arrows H and I in FIG. 21). The exemplified rotation further produces the directional rotation of the wheel assemblies 36 and 38 in the direction of Arrows J and K (see FIG. 21) in a direction consistent with the rotation of the steering bar 54 by the user of the mobility assistance device 10. During the rotation of the steering bar 54, the rotational load of the device 10 is mitigated by annular bearing sets 61 and 99, which are in rotational contact with the lower steering column 55.

Also facilitating in the compact transport of the device 10, as well as accommodating variations in height of different users is a telescoping connection 105 (see FIG. 2). The telescoping connection 105 includes a camming assembly 107 known by those skilled in the art that allow for a telescoping tube 101 to selectively telescope in-and-out (see directions of Arrows L in FIG. 3) of the upper steering column 52 when the camming assembly 107 is released. The telescoping tube 101 is capable of selectably increasing or decreasing in the direction of Arrows L, the desired height of handle bar 54 of the device 10 by loosening the camming assembly 107, adjusting the handle bar 54 to the desired height, and relocking with the telescoping tube with the camming assembly once the handle bar is at the desired position. In one example embodiment, the telescoping tube 101 allows for over 112" inches of vertical adjustment.

Energy Absorbing Assembly 16 and Operation

Figure 22:
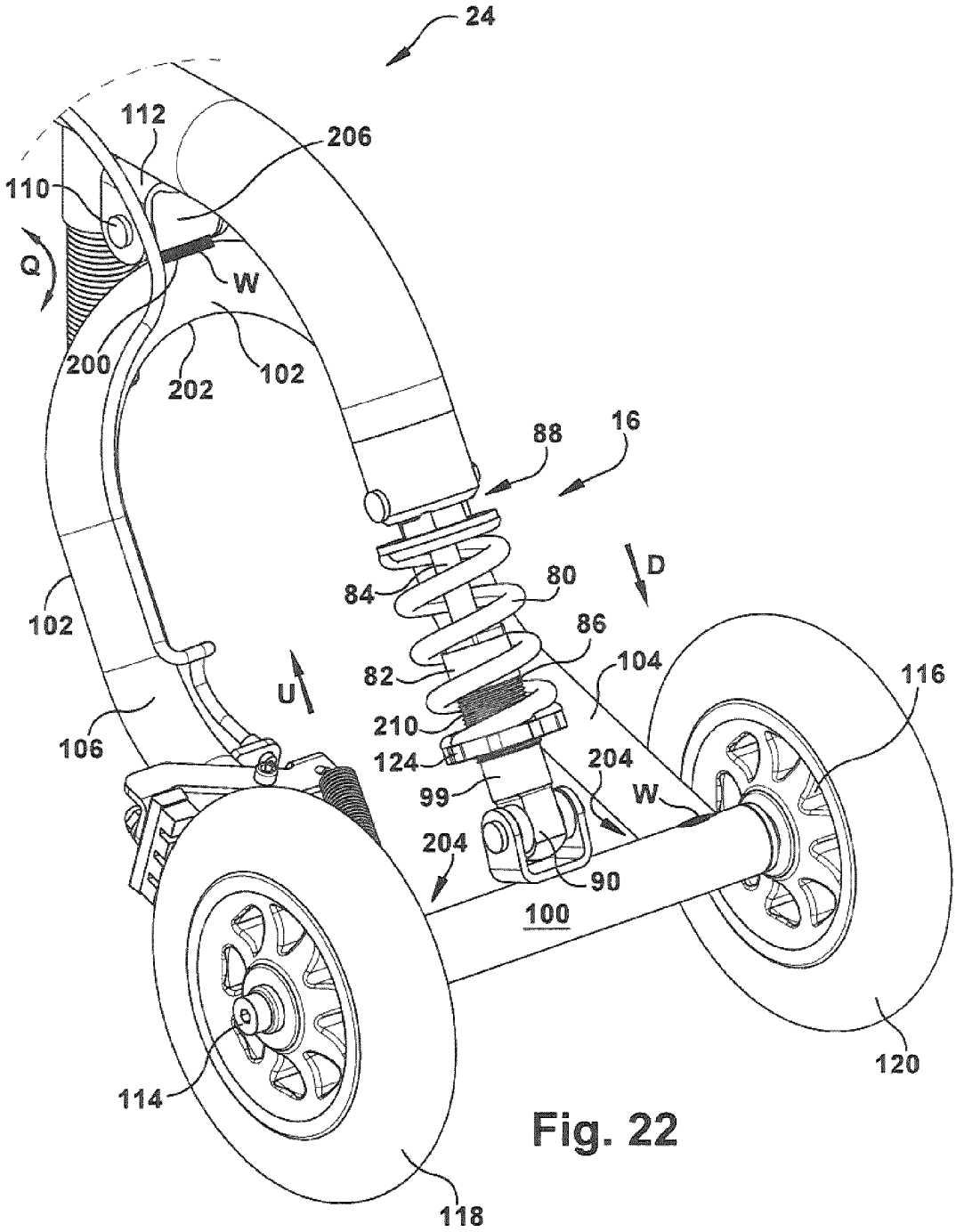
FIG. 22 is a perspective view of a energy absorbing assembly constructed in accordance with one embodiment of the present disclosure.
Figure 23:
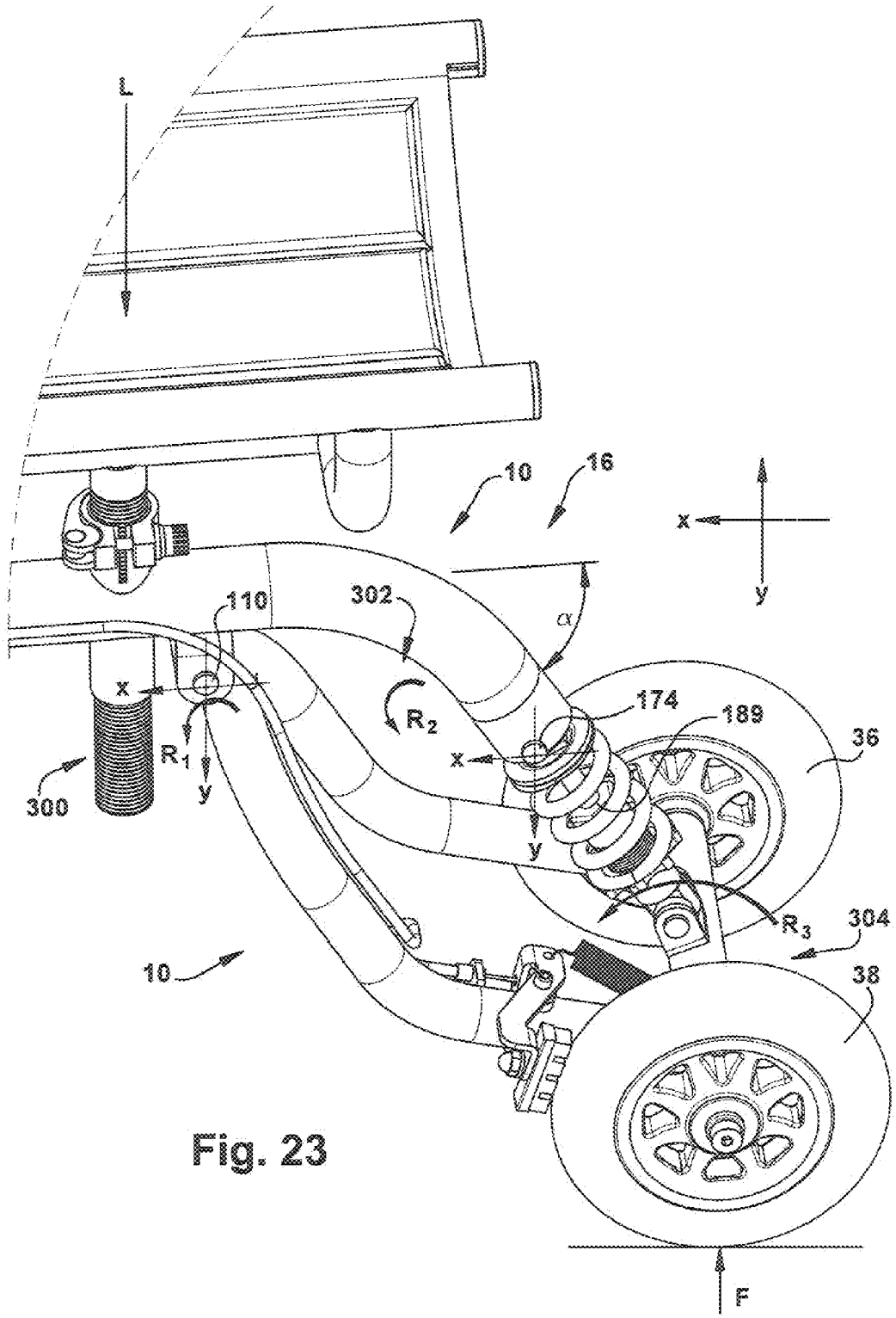
FIG. 23 is a perspective side view of the energy absorbing assembly of FIG. 22.
Figure 25:
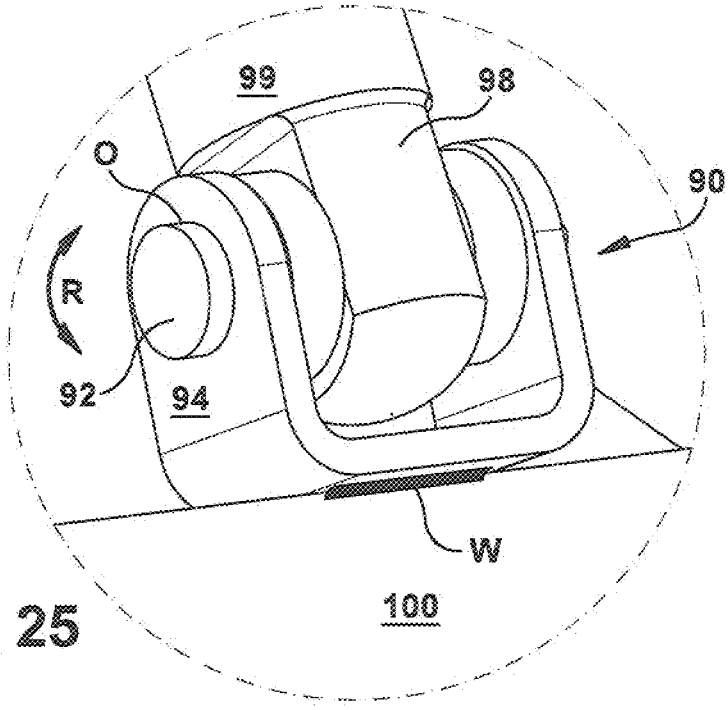
FIG. 25 is a view of a lower connection arrangement of the energy absorbing assembly constructed in accordance with one embodiment of the present disclosure.
Figure 35:
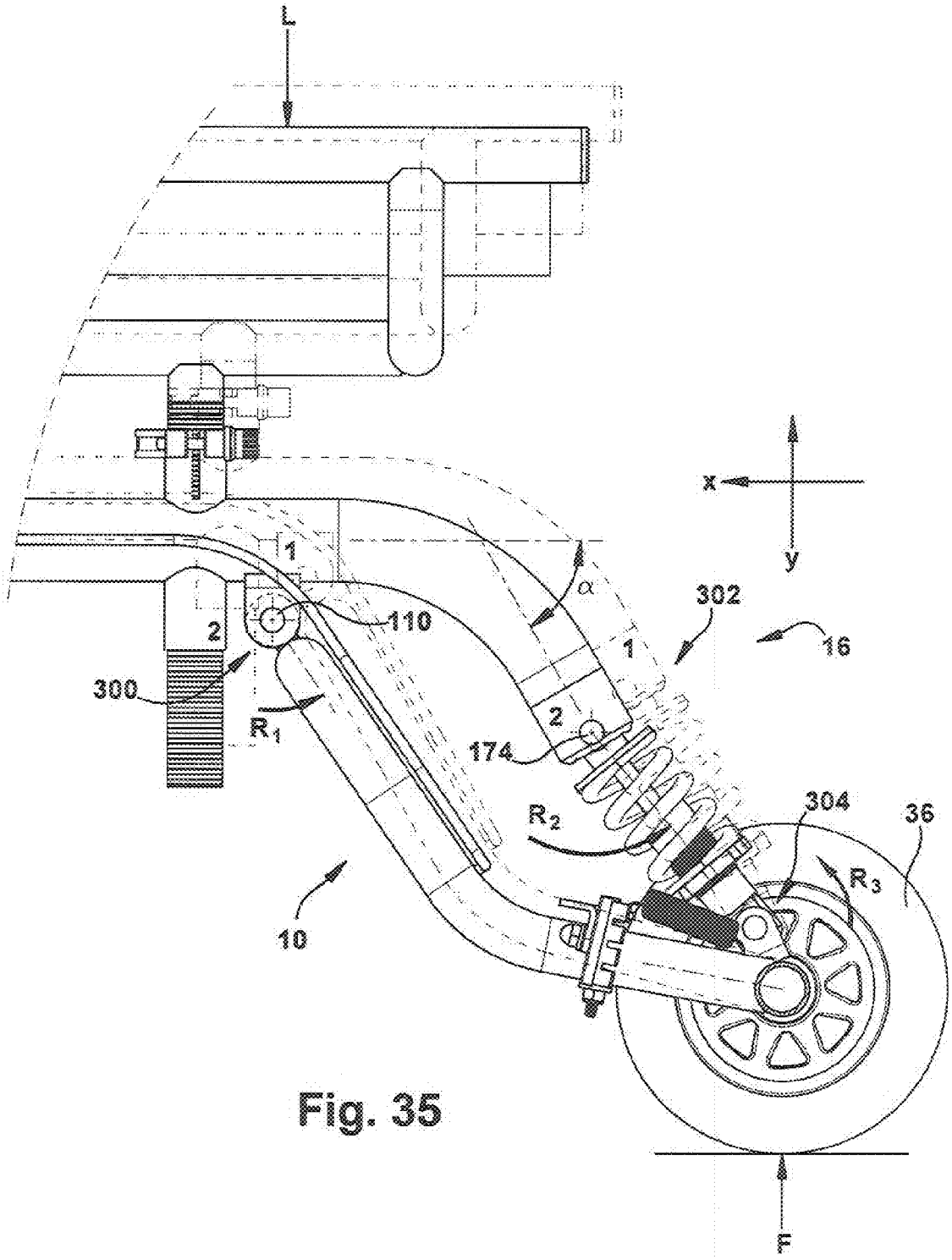
FIG. 35 is an elevation view of the mobility assistance device showing the movement of various assemblies when the device is exposed to one or more forces in accordance with one example embodiment of the present disclosure.

Illustrated in FIGS. 22 and 35 are magnified views of an energy absorbing assembly 16 constructed in accordance with one embodiment of the present disclosure. The energy absorbing assembly 16 in the illustrated embodiment is located in the rear support assembly 24 and reduces the energy and shock to user when the mobility assistance device 10 is boarded by the user for operation. For example, when the mobility assistance device 10 is boarded (shown by load or force "L") by the user for operation, the energy absorbing assembly 16 absorbs and dissipates energy along the Y and X directions axis shown in FIGS. 23 and 35. The energy absorbing assembly 16 also reduces the energy and shock (shown by force F) to the user based on loads experienced from operation and from the surface being traversed by the device 10. Such surfaces being traversed by the device 10 could include rough or undulating surfaces. The surfaces forces F are transmitted at least in part from the rear wheels 36 and 38 and respective assemblies to the energy absorption assembly 16, as shown in FIGS. 23 and 25.

The energy absorbing assembly 16 in the illustrated embodiment, desirably reduces the potential and/or kinetic energy imposed by the boarding of the user on the mobility device 10 as well as the surface and operational loads experienced during use and movement. The energy absorption assembly 16, advantageously mitigates the stress on a recovering injury and/or wear and tear resulting from frequent use to the disabled or elderly, all of which are potential users of the assistance mobility device 10. The energy absorbing assembly 16 in the illustrated embodiment of FIGS. 22-23, and 35 comprises both a spring 80 and guide rod assembly 82 for reducing oscillation and energy during boarding and use of the mobility assistance device 10. The energy absorbing assembly 16 is rotatably positioned between the arcuate portion 20B of frame member 20 and a rear axle housing 100. The energy absorbing assembly 16 is advantageously located rearwardly of the frame member 20 to maximize the energy absorption and deflection when the mobility assistance device 10 is boarded by a user or during movement.

In the illustrated example embodiment, the guide rod assembly 82 subtends the spring 80. The guide rod assembly 82 comprises a rod 84 attached to a housing 86 supporting internally at least a portion of the rod 84 through an opening 189 that allows for internal movement of the rod (within the housing) as the spring 80, rod, and device 10 translate up and down and rotate about axle housing 100. The energy absorption system 16 of the present disclosure reduces the energy transferred by the user during boarding and vibrations that would normally be experienced from operational movement of the device 10.

Returning again to FIGS. 22-23, and 35, the energy absorption assembly 16 is rotatably connected to the arcuate portion 20B of frame member 20 at an upper attachment 88 through a first pivotal connection at pin 174 and a second pivotal connection at a lower attachment 90 located on the rear axle housing 100. In situ, (without a load imposed by the user or from the surface during use on the mobility assistance device 10 shown in phantom in FIG. 35) the energy absorption assembly 16 is at an angle $\alpha$ (see FIG. 23) that is less than 90 degrees between the frame member 20 and rear axle housing 100 to further facilitate energy dissipation during boarding by the user or during operation of the device.

The lower attachment 90 of the energy absorption assembly 16 acts as a second pivot point as illustrated in the magnified view of FIG. 25. The lower attachment 90 comprises a support arm 94, a pin 92, and bushings 96, and flange 98 extending from a bottom end 99 of the guide rod assembly 82. The pin 92 is press-fit through openings "0" in the support arm 94 and supports therein the flange 98 that is axially spaced along the pin by bushings 96. The pin 92 rotates about the pin 92 in the direction of Arrows R in FIG. 25 when the device is loaded by the user and/or from surface forces during operation. In one example embodiment, the support arm 94 is fixedly attached to the rear axle housing 100 by a welded W connection as illustrated in FIG. 25.

Figure 24:
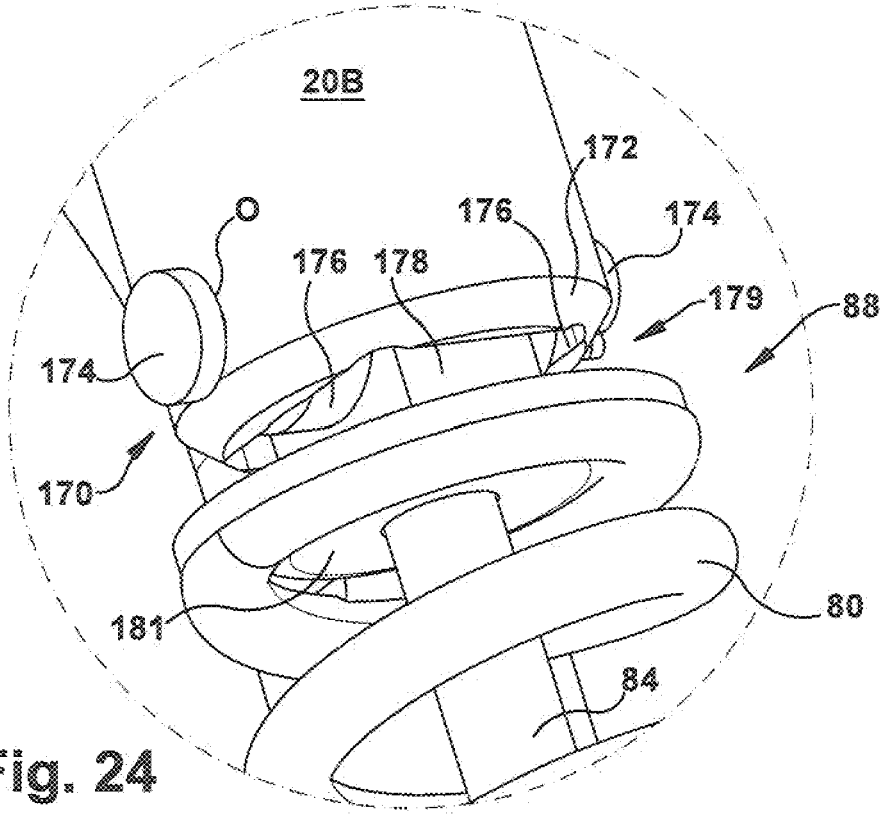
FIG. 24 is a perspective view of an upper connection arrangement of the energy absorbing assembly constructed in accordance with one embodiment of the present disclosure.

The upper attachment 88 includes an opening 170 in the lower end 172 of the arcuate portion 20B of frame member 20 as illustrated in the magnified view of FIG. 24. The upper attachment 88 comprises the pin 174, bushings 176, flange 178 rotatably connected about the pin 174, extending from an upper end 179 of the guide rod assembly 82, and stop 182. The pin 174 is press-fit through openings "0" in the arcuate portion 20B and rotatably supports therein the flange 178 that is axially spaced along the pin by bushings 176. The flange 178 as it extends toward the piston rod 84 includes a stop 181 having a thread connection therein for fixedly attaching the piston rod.

The rear support assembly 24 further comprises a rear arcuate fork 102 that includes first and second extensions 104, 106 axially spaced and rotatably located on opposite sides of the frame member 20 at a first end 200 of the rear arcuate fork. The rear arcuate fork 102 extends from an apex 202 along first and second extensions 104, 106 away from the frame member 20 to a second end 204. The second end 204 of first and second extensions 104, 106 is fixedly attached to the rear axle housing 100, by for example, a welded connection W.

Illustrated in the example embodiment of FIG. 22, the apex 202 at the first end 200 is rotatably connected to the frame member 20 through a fixture 206 connected to the apex of the arcuate fork 102. The fixture 206 is journaled by a central opening allowing for the rotation arcuate fork 102 about a pivot pin 110 and a support arm 112 connection. The rear axle housing 100 is journaled for the rotation of axles 114, 116 corresponding to third and fourth wheels 118, 120. The rear support assembly 24 like the frame member 20 and front support assembly 22 are formed from a steel tubular member, having a circular cross-section, but also could be made from any material having a similar strength-to-weight ratio or cross-sectional area without departing from the spirit and scope of the claimed disclosure.

Figure 26:
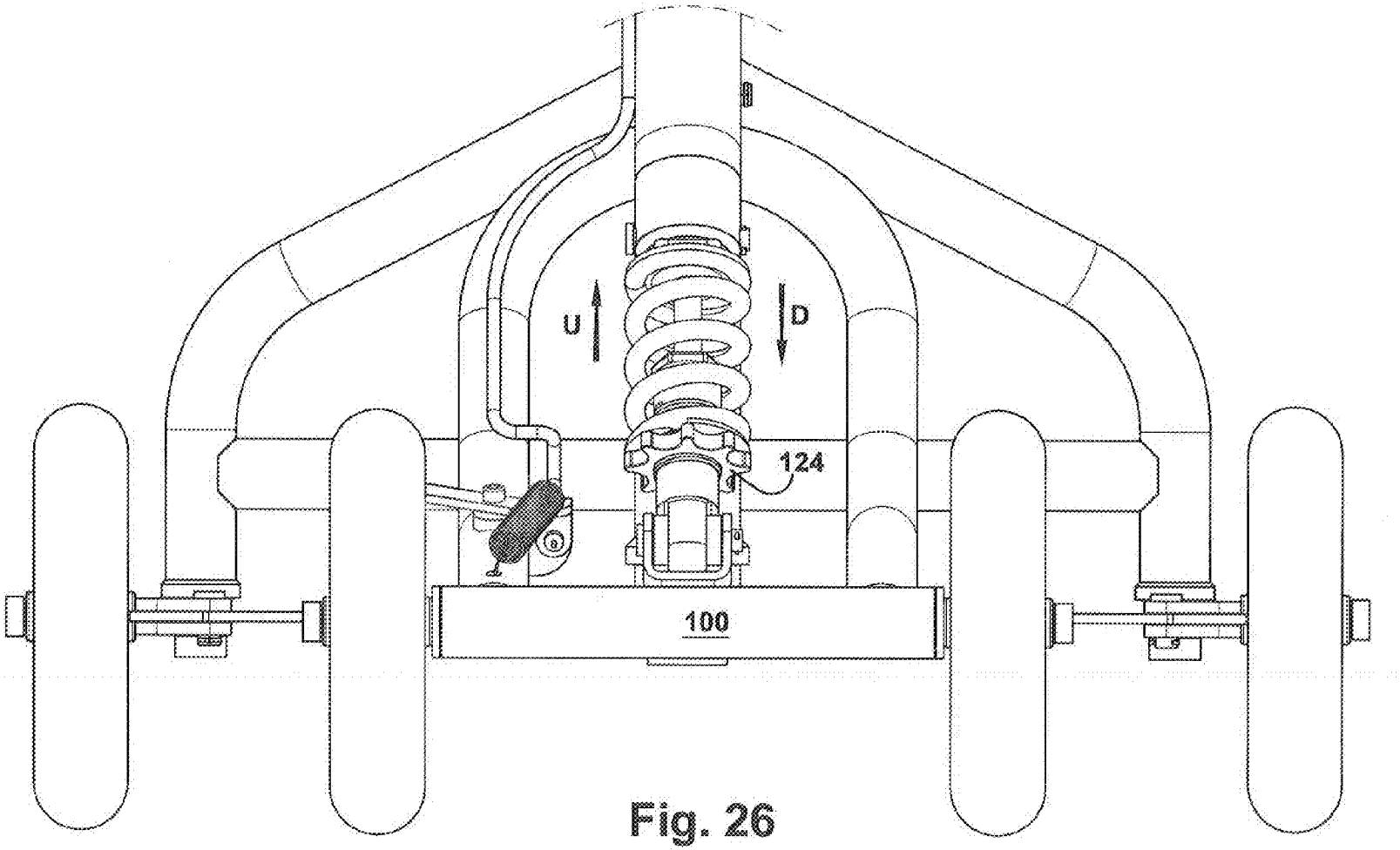
FIG. 26 is a rear view of the upper and lower connection arrangements of the energy absorbing assembly of the mobility assistance device.

Located near the bottom end 99 of the guide rod assembly 82 is a threaded adjustment 210. The threaded adjustment 210 that allows the stiffness or deflection of the mobility assistance device 10 through the spring 80 to be altered to best suit the needs of the user. The stiffness of the mobility assistance device 10 is increased (or deflection reduced in the spring 80) by rotating a nut 124 upward in direction of Arrow U in FIG. 22, compressing the spring 80 against the stop 181. Conversely, the stiffness of the mobility assistance device 10 is decreased (or deflection increased in the spring 80) by rotating the nut 124 downward in direction of Arrow D in FIGS. 22 and 26, reducing the compression of the spring 80 from the stop 181. The threaded adjustment 210 when used in the manner described above, allows the energy absorption to be increased or decreased in the device 10 as desired by the user. The threaded adjustment 210 also allows for the level of energy absorption to be the same for users of the device 10 of different weight, imposing a different load or forces on the device during operation. In one example embodiment, the energy absorption assembly 16 of FIG. 22 comprising spring 80, nut 124, guide rod assembly 82 and rod 84 is a product sold Summe corporation and distributed by WE LOT under parts number SU-SO2-RED for 125 mm providing a spring rate of 1500 lbs. In yet another example embodiment, the mobility assistance device is capable of supporting users of over 400 pounds.

Figure 33:
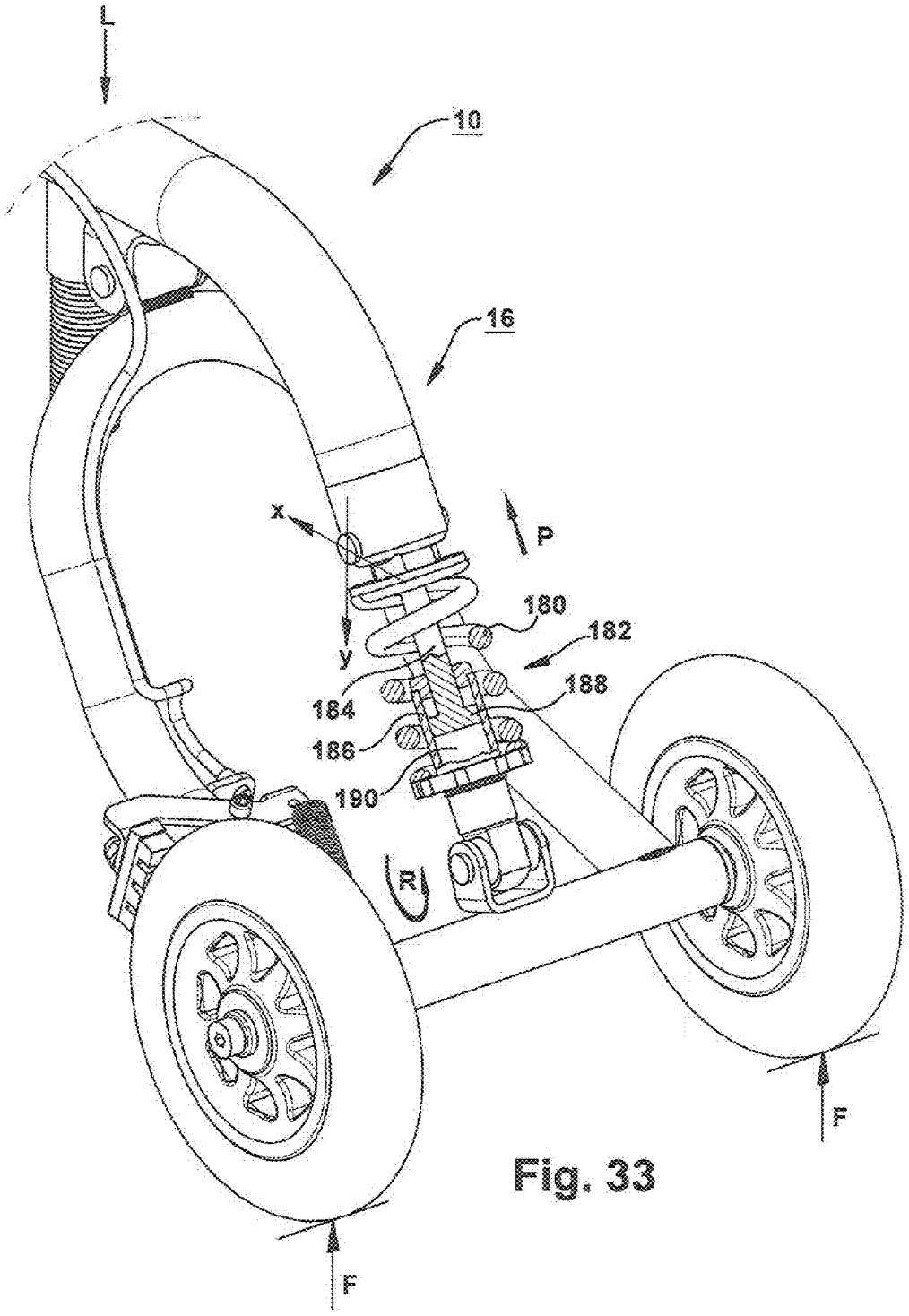
FIG. 33 is a perspective view of an energy absorption assembly constructed in accordance with another example embodiment of the present disclosure.

In an alternative example embodiment, the energy absorbing assembly 16 comprises a spring 180 and dampening unit 182 as illustrated in FIG. 33. The energy absorbing assembly 16 reduces oscillation and energy during boarding and movement of the mobility assistance device 10. The dampening unit comprises a piston rod 184 located within the spring 180 and extends into a piston cylinder 186 where the piston rod is attached to a piston 188. The piston 188 and piston rod 184 translate up and down within the cylinder 186 when user loads L or surface forces F are imposed on the device 10.

The energy absorption system 16 of the present disclosure and in particular dampening unit 182 reduces the energy transferred by the user during boarding or by surface forces experienced during operation, for example by converting the energy to heat or sound. In particular, the user's boarding of the mobility assistance device 10 results in a piston rod 184 and piston 188 within the cylinder 186 to move resistingly downward relative to the piston cylinder, as indicated by Arrows P in FIG. 33.

In one example embodiment, the dampening unit 182 comprises a viscous dampening system using a fluid medium 190 within the piston cylinder 186 such as air, gas, water, oil, and the like to dissipate or reduce the energy to the mobility assistance device 10 experienced by the boarding of the user or the operation of the device over surfaces. In another example embodiment, the dampening unit 182 comprises coulomb or dry friction dampening system where the dampening force is opposite in direction to that of the motion of the mobility assistance device 10, reducing the energy by friction that occurs between two rubbing surfaces that are either dry or have substantially no lubrication. For example, the piston 188 within the piston cylinder 186 is without lubrication, resulting in an example of the dry friction unit.

Figure 32:
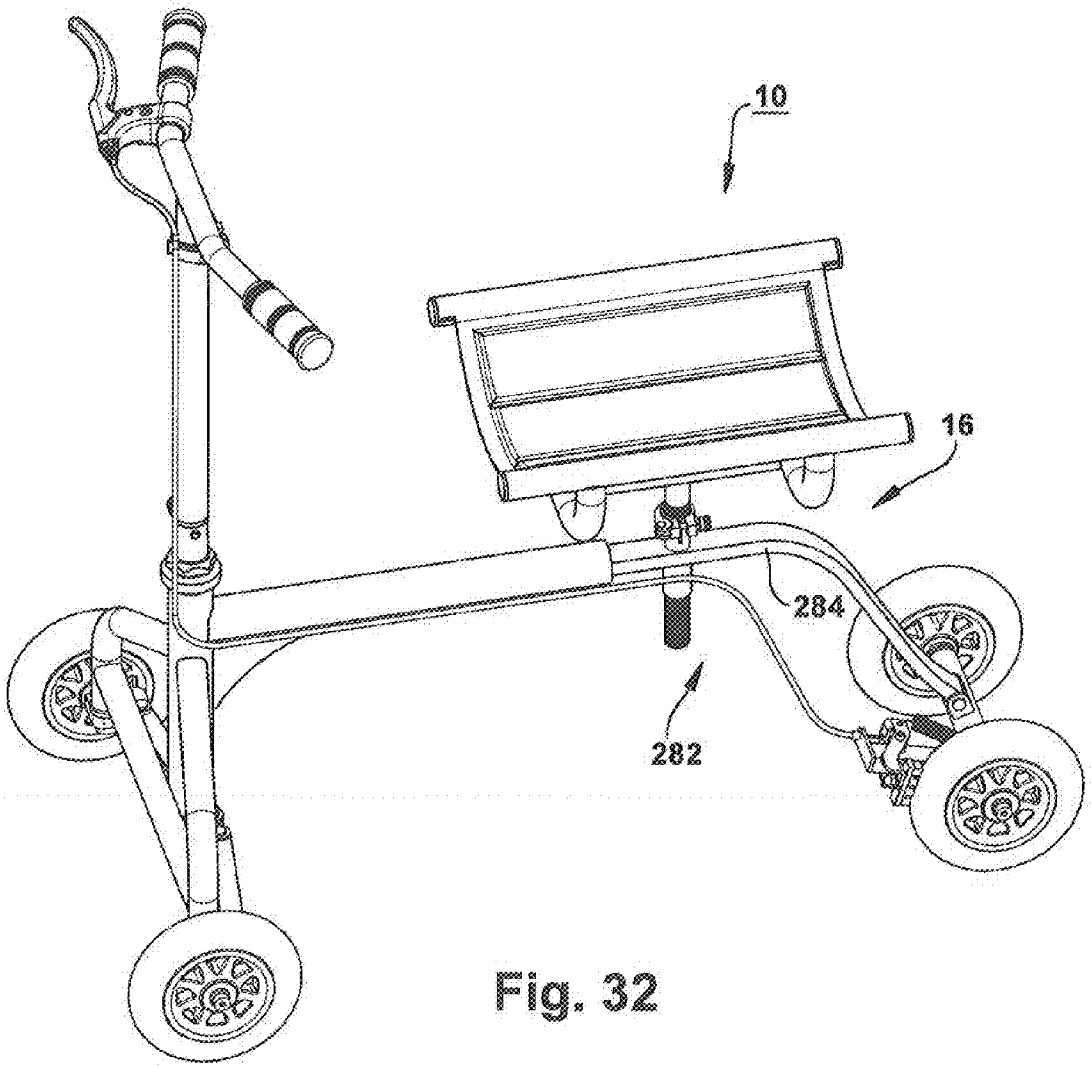
FIG. 32 is a perspective view of a mobility device having an energy absorption assembly constructed in accordance with one example embodiment of the present disclosure.

In yet another example embodiment, the dampening unit 282 comprises a material or solid or hysteretic dampening system where the energy to the device 10 imposed by the boarding of the user or operation of the device over surfaces is dissipated and absorbed by deformation of the material in the dampening unit. Stated another way, the energy is dissipated and absorbed in the dampening unit 282 due to friction between internal planes of the material, which slip or slide (resulting in stress and/or strain) as the deformation takes place. One example embodiment of such a dampening unit comprises a deflector plate 284 attached to the frame member 20 and rear axle housing 100 as illustrated in FIG. 32. In one example embodiment, the deflector plate 284 is made from a composite or polymeric material. In yet another embodiment, the deflector plate 284 is made from carbon fiber. In yet another embodiment, the energy absorption assembly 16 comprises only a dampening unit 184.

Operation of the Energy Absorption Assembly 16

FIG. 35 illustrates an unloaded position 1 (in phantom) and loaded position 2 (in solid) the displacement that occurs to the mobility assistance device 10 when subjected to the loading forces L by the boarding of a user or reactant forces F that occur during operational movement of the device, generated from the surface or ground (hereinafter collectively "Loading Forces"). As illustrated in the example embodiment of FIG. 35, a first displacement zone 300 is shown wherein pin 110 and corresponding components of the rear support assembly 16, such as of the rear fork 102 are translated along directions x and y from position 1 to position 2 when the device 10 is subjected to Loading Forces. The fixture 206 further allows for the rotation of the fork 102 toward position 2 as indicated by R1 in FIG. 35. A second displacement zone 302 is illustrated in FIG. 35 wherein pin 174 and corresponding components of the energy absorption assembly 16, such as the spring 80, guide rod assembly 82, and pin 174 are translated along directions x and y from position 1 to position 2 when the device 10 is subjected to Loading Forces. The upper flange 178 and pin 174 along with the lower attachment 90 further allow for the rotation of the corresponding components of the energy absorption assembly 16, such as the spring 80, guide rod assembly 82, and pin 174 from position 1 to position 2 as indicated by R2 in FIG. 35. The lower attachment 90 of the energy absorption assembly 16 further allows for the rotation R3 in a third displacement zone 304 as illustrated in FIG. 35

The maximizing of the energy absorption through the use of the spring 80 and/or dampening unit 82 is also achieved by the arcuate shape of the frame member 20, and the rearward location and angle $\alpha$ (see FIG. 23) of the energy absorption unit 16 along the frame member 20. Energy is also advantageously reduced by the harmonized rotational configuration of the energy absorption 16 and rear support 24 assemblies. In particular, during a loading condition by the boarding of a user or the reactant forces from operating the mobility assistance device 10, the energy absorption is additionally maximized in the energy absorption assembly 16 through concomitant or concurrent rotation of the rear support 24 and energy absorption assembly 16 at three the different locations indicated by R1, R2, and R3 in FIG. 35.

Braking Arrangement 18 and Operation

Figure 28:
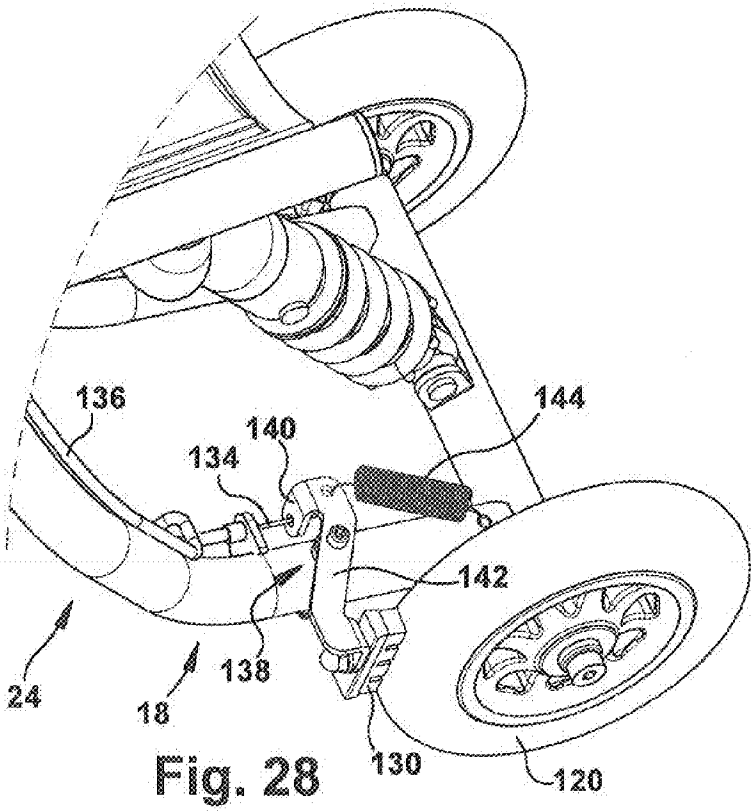
FIG. 28 is a side view of a braking arrangement constructed in accordance with one embodiment of the present disclosure.
Figure 27:
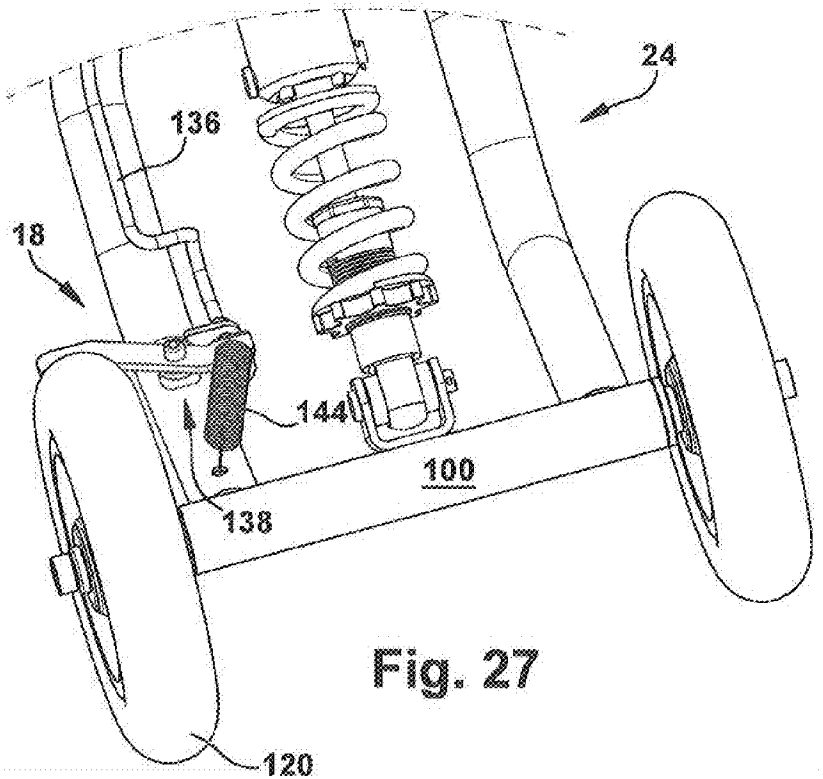
FIG. 27 is a rear partial perspective view of the lower connection arrangement of the energy absorbing assembly and braking assembly of the mobility assistance device.
Figure 29:
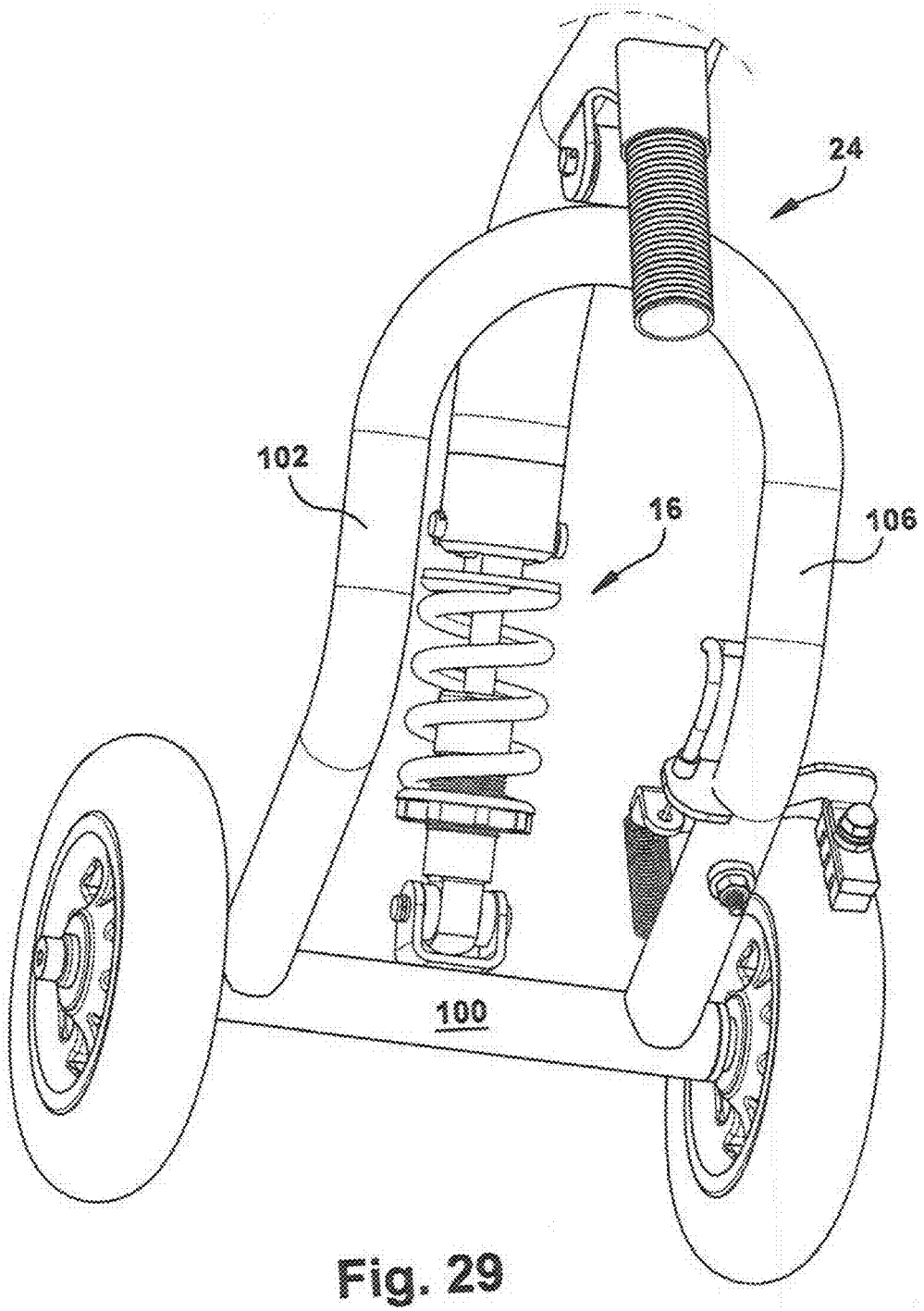
FIG. 29 is another view of the braking arrangement of the mobility assistance device.

Illustrated in FIGS. 11 and 27-28 is a braking arrangement 18 constructed in accordance with one example embodiment of the present disclosure. The braking arrangement 18 assists the user in slowing down or stopping the mobility assistance device 10 by application of a friction plate 130 against any one of the wheels 36, 38, 118, or 120, and in the illustrated embodiment, the fourth wheel 120. The friction plate 130 engages the wheel 120 upon actuation of a brake lever 132 (see FIG. 11 by a hand of the user during operation). Actuation of the brake lever 132 pulls a brake cable 134 that extends through a brake housing 136 to a mounting surface 138 located on the rear assembly 24. The pulling of the brake cable 134 rotates a pivot shaft 140 attached to an extension 142 of the friction plate 130, resulting the rotation of the extension and friction plate such that the friction plate engages and slows or stops rotation of wheel 120 during a braking condition. When the operator releases the brake lever 132, the cable is released from the housing 136 to the rear assembly 24 by a biasing member 144 that pulls the excess cable 134 from the pivoting shaft 140 and biases the friction plate away from the wheel 120 to a mobility position.

Support Assembly 14 and Operation

Illustrated in FIGS. 1 and 2 is a support assembly 14 constructed in accordance with one example embodiment of the present disclosure. The support assembly 14 is constructed to carry the user's leg and foot, and specifically the distal portion of the leg from the kneecap down. Typically, the user's knee seeking support is bent at 90 degrees from an upright position and positioned within the support assembly 14 during use of the mobility assistance device 10. The support assembly 14 comprises a sling assembly 310, support fixturing 312, support post 158, camming assembly 160, and support housing 162.

Figure 34:
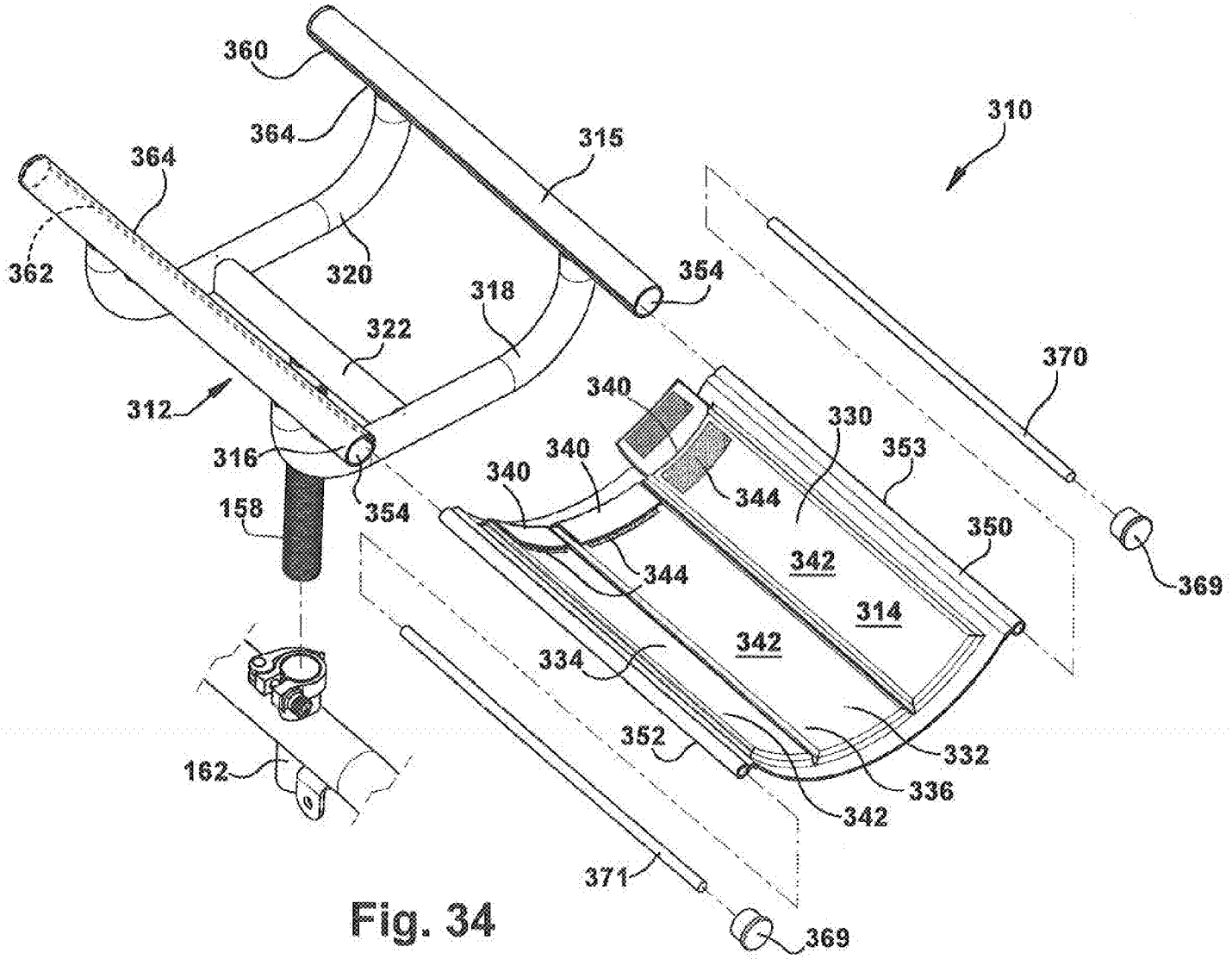
FIG. 34 is an exploded perspective view of a sling assembly constructed in accordance with one embodiment of the present disclosure.

The sling assembly 310 as further illustrated in FIG. 34 comprises a sling 314 and the support fixturing 312. The support fixturing 312 comprises two longitudinal main tubes 315 and 316 and two lateral support tubes 318 and 320. The support fixturing 312 is connected to the support post 158 by a connection tube 322. The support fixturing 312 and connection tube 322 in one example embodiment are constructed of tubular steel and welded together at their connection points.

The sling 314 is made from a fabric. In one example embodiment, the fabric forming the sling 314 is a stretch resistant fabric. One suitable example of a stretch resistant fabric includes a vinyl-coated fabric of approximately 18 oz having 1000×1300 denier polyester yarns that are mildew resistant. Such a suitable example is sold under part number 6352-005 by Rochford Supply having an office at 7624 Boone Ave. N., Suite 200 Brooklyn Park, Minn. 55428 and a website selling such products found on the world-wide-web at www.rochfordsupply.com. In yet another example embodiment, the sling is made from a fabric having anti-microbial properties. The sling 314 in the illustrated example embodiment of FIGS. 1 and 34 further comprises a plurality of pockets 330, 332, and 334. In the illustrated example embodiment, three pockets are shown running along a longitudinal outer surface 336 of the sling 314. The pockets 330-334, each include an opening 340 for the insertion of various sized padding 342 for cushioning the users' legs during use. The padding 342 can be removed and cleaned as needed by the user. In one example embodiment, the padding 342 is a foam padding and secured in the openings 340 by a flap 344 having a Velcro® closing connection over the openings.

The sling 314 further comprises first and second housings 350 and 352 that are sewn into the fabric of the sling along a longitudinal edge 353 that support first and second rods 370, 371. The rods 370 and 371 when positioned in the housings 350, 352 are received in openings 354 corresponding to the longitudinal main tubes 315 and 316. When the rods 370 and 371 are disposed within the respective housings, 350, 352 then inserted into the openings 354, the housings and rods are retained in the longitudinal main tubes 315 and 316. As a result of such positioning, the majority of the fabric forming the sling 314 passes through to the outside of the main tubes through first and second slots 360, 362, respectively, located along an inner profile 364 of the longitudinal main tubes 315 and 316. The openings 354 are then closed with caps 369 to secure the sling 314 within the tubes 315 and 316.

Such securing of the sling 314 to the main longitudinal tubes 315 and 316 provides for easy removal of the sling for cleaning and further forms a comfortable radius or arcuate web within the support fixturing 312 for resting the users' legs during use of the device 10. In an alternative example embodiment, the rods 370 and 371 can be removed from the sling 314 to further facilitate washing of the sling.

During use, the user positions the distal portion of his or her leg (recovering from injury) within the sling assembly 310. The user's knee during use is typically resting in or in front of the sling 314. The support fixturing 312 is attached to the supporting post 158 and can be adjusted vertically to accommodate the desired height of the user by releasing the camming assembly 160. The camming assembly 160 is known by those skilled in the art and allows the supporting post 158 to be selectively adjusted in-and-out (see directions of Arrows S in FIG. 2) of the supporting housing 162 when the camming assembly 160 is released. In one example embodiment, a suitable product to be used for the camming assembly 160 includes seat clamp part number SU-QRBO2 sold by Ningbo Haoyi Bicycle Company of Ningbo, China.

The selectable adjustment of the supporting post 158 accommodates for different leg heights between users of the mobility assistance device 10. In one example embodiment, the vertical adjusting of the support post 158 provides over six 6" inches of travel.

Figure 14:
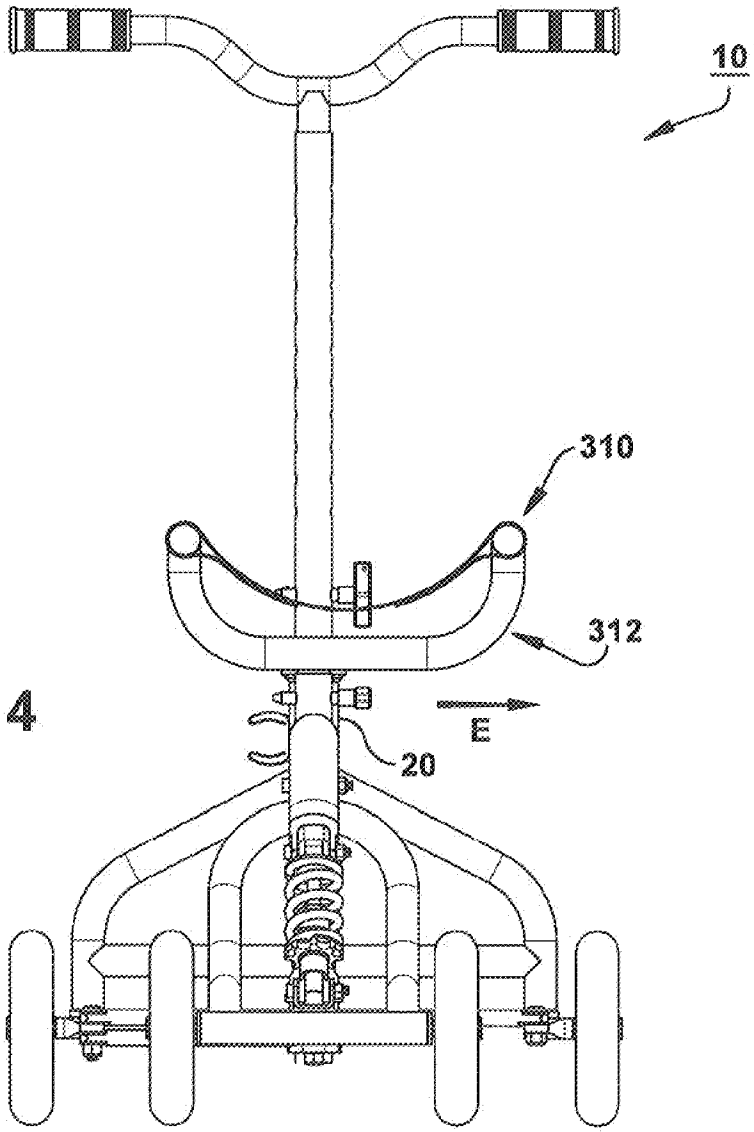
FIG. 14 is a rear perspective view of the mobility assistance device shown in FIG. 12.

In the illustrated example embodiment of FIG. 14, it can be appreciated that the support fixturing 312 is eccentrically located axially about the frame member 20 in the direction of Arrow E. This allows the sling to accommodate users with injuries to their left leg as looking from the rear view of FIG. 14. Advantageously, the symmetrical configuration of the sling assembly 310 and support assembly 14, the sling assembly can be rotated 180 degree to accommodate users with injuries to their right leg by simply releasing the camming assembly 160 and rotating the support post 158. The support post 158 is then retightened once the desired position of the support assembly 14 is obtained.

Figure 19:
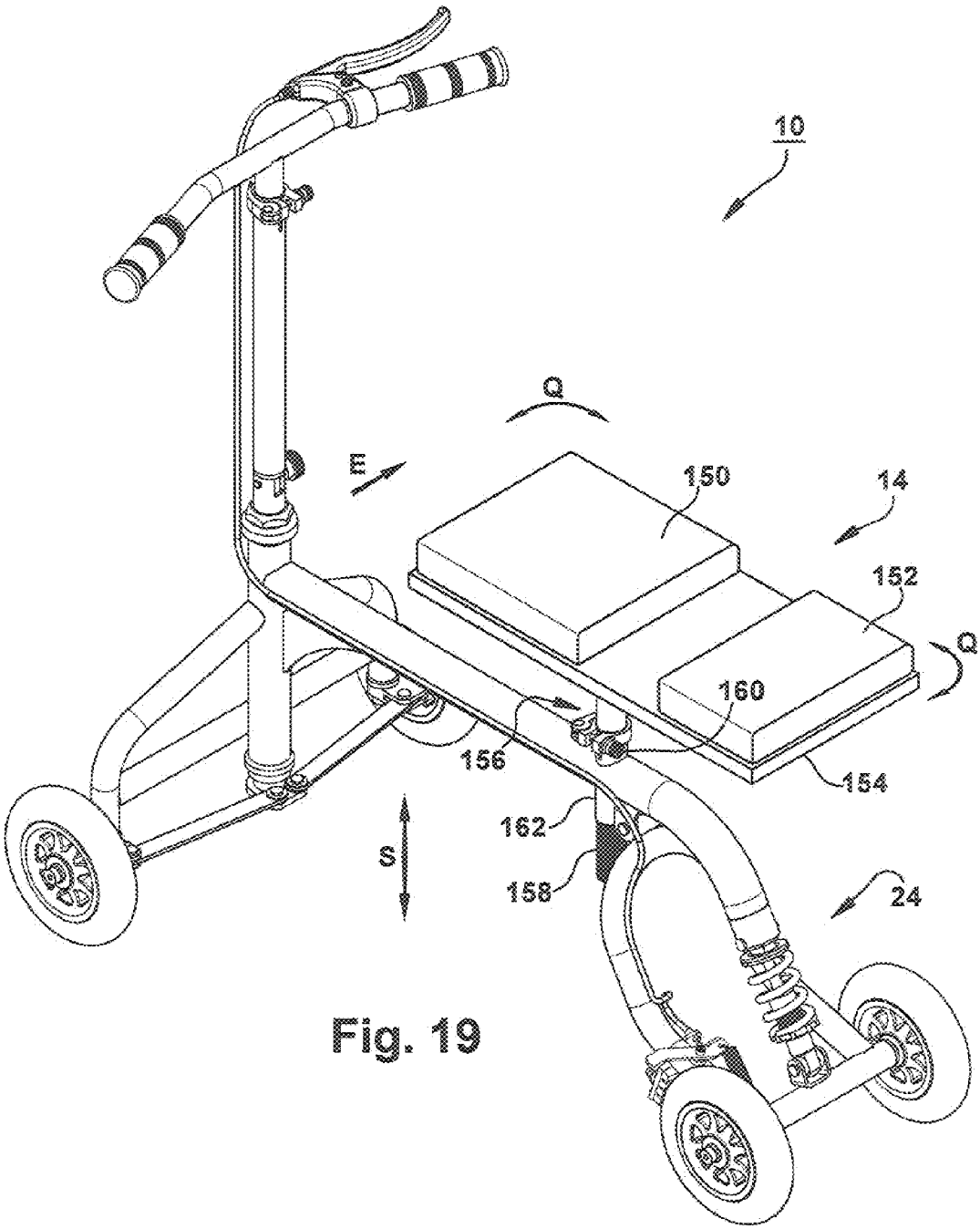
FIG. 19 a perspective view of a mobility assistance constructed in accordance with another embodiment of the present disclosure.

Illustrated in FIG. 19 is a support assembly 14 constructed in accordance with another embodiment of the present disclosure. The support assembly 14 is constructed to carry the user's leg and specifically the distal portion of the leg, typically bent at the user's knee during use of the mobility assistance device 10. The support assembly 14 comprises first and second leg pads 150, 152, pad support plate 154, support post 158, camming assembly 160, and support housing 162.

During use, the user positions the distal portion of his or her leg upon first and second pads, 150, 152. The user's knee during use is typically resting on or in front of the first pad 150 and distal portion extending therefrom resting in-part on second pad 152 with the user's foot extending beyond the second pad toward the rear assembly 24. Located below and adhesively attached to the first and second pads 150 and 152 is the support plate 154. The support plate 154 is attached to a supporting post 158 through a supporting fixture 156 (not shown) that allows for the rotation of the support plate 154 and pads 150, 152 in the direction of the Arrows Q illustrated in FIG. 19. The support plate can be rotated and repositioned by the loosening of a fixture fastener 157, (not shown) such as a bolt or screw. The camming assembly 160 known by those skilled in the art allows the supporting post 158 to be selectively adjusted in-and-out (see directions of Arrows S in FIG. 19) of the supporting housing 162 when the camming assembly 160 is released. The selectable adjustment of the supporting post 158 accommodates for different leg heights between users of the mobility assistance device 10.

In the illustrated example embodiment of FIG. 19, it can be appreciated that the support plate 154 is eccentrically located axially about the frame member 20 in the direction of Arrow E. This allows support pads 150 and 152 to accommodate users with injuries to their left leg as looking from the rear view of FIG. 19. Advantageously, the symmetrical configuration of the support plate 154 and pads 150, 152, allow the plate to be rotated 180 degrees to accommodate users with injuries to their right leg by simply releasing the camming assembly 160 and rotating the support post 158. The support post is then retightened once the desired position of the support assembly 14 is obtained.

Figure 15:
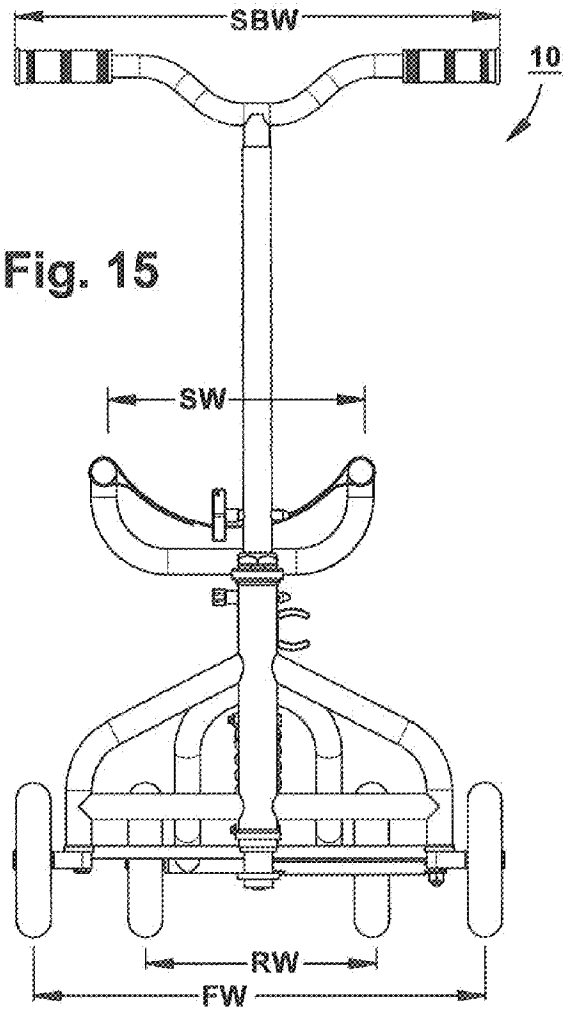
FIG. 15 is a front elevation view of the mobility assistance device shown in FIG. 12

Illustrated in FIGS. 15 and 16 are overall dimensions for the mobility assistance device 10 constructed in accordance with one example embodiment of the present disclosure. The overall length represented by dimension L is approximately twenty-nine (29") inches. The overall height represented by dimension H is approximately thirty-one (31") inches. The overall width of the front wheel represented by dimension FW is approximately seventeen (17") inches. The overall width of the rear wheels represented by dimension RW is approximately nine (9") inches. The overall width of the sling represented by dimension SW is approximately ten (10") inches. The overall width of the steering bar represented by dimension SBW is approximately nineteen (19") inches. The overall length of the sling represented by dimension SLW is approximately thirteen (13") inches. It is to be appreciated that variations in size whether larger or smaller with respect to any of the dimensions cited in the example embodiment of FIGS. 15 and 16 are intended to be within the scope of the present disclosure.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A mobility assistance device comprising:

a frame member having a set of wheels rotatably connected thereto for rotational movement of the mobility assistance device;

a rear support assembly rotatably connected to said frame member about a first pivot point at a first end of said support assembly, the rear support assembly operably connected at a second end to an axle housing operably connected to said set of wheels; and a spring assembly operably connected at a proximal end to said frame member and rotatably connected at distal end to form a second pivot point with said axle housing, the mobility assistance device pivoting about said first and second pivot points upon experiencing a change in the load on the mobility assistance device, wherein said frame member further comprises an arcuate portion having first and second ends, the arcuate portion being integrally connected at said first end to a substantially linear segment of said frame member and operably connected at said second end, and coupled directly to, said spring assembly.

2. A mobility assistance device for use as a walking aid comprising:

a frame member extending from a front assembly to a rear assembly, said front and rear assemblies comprising a pair of wheels for rotational movement of the assistance device;

a support assembly extending from said frame member and positioned between said front and rear assemblies for supporting a limb of an operator during use;

a steering assembly extending from said front assembly providing directional control of the mobility assistance device during use; and an energy absorption assembly located between said frame member and a rear axle housing of the rear assembly, the energy absorption assembly having first and second ends, the first end being operably connected to said frame member and the second end being rotatably connected to the rear axle housing assembly that is rotatably connected to said pair of wheels of the rear assembly, wherein said frame member further comprises an arcuate portion having first and second ends, the arcuate portion being integrally connected at said first end to a substantially linear segment of said frame member and operably connected at said second end, and coupled directly to, said spring assembly.

3. The mobility assistance device of claim 2 further comprising a rear fork assembly having first and second ends, the first end being rotatably connected to said frame member and said second end connected to said axle housing.

4. The mobility assistance device of claim 3 wherein concomitant rotation occurs along the second end of said energy absorption assembly and said first end of said rear fork assembly thereby enhancing the energy absorption of the energy absorption assembly from the boarding or operational movement of the mobility assistance device by an operator.

5. The mobility assistance device of claim 2 wherein said energy absorption assembly comprises a spring surrounding a guide rod and housing such that translation of the spring during the absorption of energy induces a corresponding translation in the guide rod in and/or out of an opening of the housing.

6. The mobility assistance device of claim 2 wherein said second end of the energy absorption assembly further comprises a lower attachment assembly having a rotatable flange, a pin, and support arm, the flange being pivotally connected about the pin that is housed within the support arm, the support arm being fixedly attached to said rear axle housing such that energy absorption occurs through the rotation flange about said pin and support arm during the boarding or operational movement of the mobility assistance device by an operator.

7. The mobility assistance device of claim 2 wherein said support assembly further comprises a sling assembly having an arcuate web for supporting a user's leg during use of the mobility assistance device.

8. The mobility assistance device of claim 7 wherein said arcuate web of said sling assembly further comprises a stretch resistant fabric.

9. The mobility assistance device of claim 8 wherein said fabric forming said arcuate web further comprises an antimicrobial coating.

10. The mobility assistance device of claim 8 wherein said fabric forming said arcuate web further comprises a plurality of pockets for receiving padding for supporting a user's leg during use of the mobility assistance device.

11. The mobility assistance device of claim 7 wherein said sling assembly is removably supported by first and second longitudinal tubes comprising a slotted opening for receiving corresponding first and second sides of an arcuate web forming a sling.

12. The mobility assistance device of claim 2 wherein said steering assembly further comprising a pivot assembly for rotatably positioning a steering column and attached handle bar between a collapsed position and an upright operable position.

13. The mobility assistance device of claim 12 wherein said pivot assembly further comprises a key having an opening, said key being rotatably located within a slotted housing having a passage for a fastener, such that the tightening and loosening of the fastener through said opening and passage adjusts ability for the steering column and handle bar to move between said collapsed and operable positions.

14. A mobility assistance device for use as a walking aid comprising:

a frame member having an arcuate portion, the frame member extending from a front assembly to a rear assembly, said front and rear assemblies comprising a pair of wheels for rotational movement of the assistance device;

a support assembly extending from said frame member and positioned between said front and rear assemblies for supporting a limb of an operator during use, the support assembly comprising a sling arrangement having an arcuate web formed from fabric;

a steering assembly extending from said front assembly providing directional control of the mobility assistance device during use; and an energy absorption assembly located between said arcuate portion of said frame member and a rear axle housing of the rear assembly, the energy absorption assembly having first and second ends, the first end being operably connected to said arcuate portion of said frame member and the second end being rotatably connected to a substantially central portion of the rear axle housing assembly that is rotatably connected to said pair of wheels of the rear assembly.

15. The mobility assistance device of claim 14 further comprising a rear fork assembly having first and second ends, the first end being rotatably connected to said frame member and said second end connected to said axle housing.

16. The mobility assistance device of claim 15 wherein concomitant rotation occurs along the second end of said energy absorption assembly and said first end of said rear fork assembly thereby enhancing the energy absorption of the energy absorption assembly from the boarding or operational movement of the mobility assistance device by an operator.

17. The mobility assistance device of claim 14 wherein said sling arrangement is removably supported by first and second longitudinal tubes of said support assembly, the first and second longitudinal tubes comprising a slotted opening for receiving corresponding first and second sides of said arcuate web forming a sling.

18. The mobility assistance device of claim 14 wherein said arcuate web further comprises a plurality of pockets for receiving padding for supporting a user's leg during use of the mobility assistance device.

19. A mobility assistance device for use as a walking aid comprising:

a frame member having an arcuate portion, the frame member extending from a front assembly to a rear assembly, said front and rear assemblies comprising a pair of wheels for rotational movement of the assistance device;

a support assembly extending from said frame member and positioned between said front and rear assemblies for supporting a limb of an operator during use, the support assembly comprising a sling arrangement having an arcuate web formed from fabric;

a steering assembly extending from said front assembly providing directional control of the mobility assistance device during use, the steering assembly comprising a pivot assembly for rotatably positioning a steering column and attached handle bar between a collapsed position and an upright position;

an energy absorption assembly located between said arcuate portion of said frame member and a rear axle housing of the rear assembly, the energy absorption assembly having first and second ends, the first end being operably connected to said arcuate portion of said frame member and the second end being rotatably connected to a substantially central portion of the rear axle housing assembly that is rotatably connected to said pair of wheels of the rear assembly; and a rear fork assembly having proximal and distal ends, the proximal end being rotatably connected to said frame member and said distal end being fixedly connected to said axle housing such that concurrent rotation occurs along the second end of said energy absorption assembly and said proximal end of said rear fork assembly during loading to enhance the energy absorption of the energy absorption assembly.

20. A mobility assistance device for use as a walking aid comprising:

a frame member having an arcuate portion with first and second ends, the frame member extending from a front assembly to a rear assembly, the arcuate portion being integrally connected at said first end to a substantially linear segment of said frame member, said front and rear assemblies each comprising a pair of wheels for rotational movement of the assistance device, the rear assembly being rotatably connected to said pair of wheels at lateral ends of the rear assembly;

a support assembly extending from said frame member and positioned between said front and rear assemblies for supporting a limb of an operator during use, the support assembly comprising a sling arrangement having an arcuate web formed from fabric, said sling arrangement being removably supported by first and second longitudinal tubes comprising a slotted opening for receiving corresponding first and second sides of the arcuate web forming the sling;

a steering assembly extending from said front assembly providing directional control of the mobility assistance device during use, the steering assembly comprising a pivot assembly for rotatably positioning a steering column and attached handle bar between a collapsed position and an upright position;

an energy absorption assembly located between said arcuate portion of said frame member and a rear axle housing of the rear assembly, the energy absorption assembly having first and second ends, the first end being operably connected to said arcuate portion of said frame member and the second end being rotatably connected to and coupled directly to a medial portion of the rear axle housing assembly, the energy absorption assembly being directly in alignment with the arcuate portion of the frame and the rear assembly, the energy absorption assembly being located below and spaced from the support assembly; and a rear fork assembly having proximal and distal ends, the proximal end being rotatably connected to said frame member and said distal end being fixedly connected to said axle housing such that concurrent rotation occurs along the second end of said energy absorption assembly and said proximal end of said rear fork assembly during loading to enhance the energy absorption of the energy absorption assembly.

* * * * *